US006118065A

United States Patent [19]

Haruyama

[11] Patent Number: 6,118,065

[45] **Date of Patent: *Sep. 12, 2000**

[54] AUTOMATIC PERFORMANCE DEVICE AND METHOD CAPABLE OF A PRETENDED MANUAL PERFORMANCE USING AUTOMATIC PERFORMANCE DATA

[75] Inventor: Kazuo Haruyama, Hamamatsu, Japan

[73] Assignee: Yamaha Corporation, Hamamatsu, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/026,199

[22] Filed: Feb. 19, 1998

[30] Foreign Application Priority Data

Feb. 21, 1997 [JP] Japan ..... 9-053993

[51] Int. Cl.[7] ..... G10H 7/00; G10H 1/36

[52] U.S. Cl. ..... 84/609; 84/610; 84/612; 84/634; 84/636; 84/649; 84/652

[58] Field of Search ..... 84/601–606, 609–612, 84/615–616, 634–636, 649–652

[56] References Cited

U.S. PATENT DOCUMENTS 5,565,640 10/1996 Hasebe .
5,600,082 2/1997 Torimura ..... 84/610

FOREIGN PATENT DOCUMENTS 56-50389 5/1981 Japan .
9-062265 3/1997 Japan .
9-160551 6/1997 Japan .

*Primary Examiner*—Bentsu Ro
*Assistant Examiner*—Marlon T. Fletcher
*Attorney, Agent, or Firm*—Morrison & Foerster

[57] ABSTRACT

As automatic performance data are sequentially supplied at a given tempo, a player sequentially depresses keyboard keys at appropriate timing. Comparison is made between timing of each manual key-on event and timing of key-on and key-off events of each automatic performance note in the performance data. If key-on timing of a given automatic performance note is within a predetermined allowable difference from given manual key-on timing, a tone based on the given automatic performance note is generated at a time corresponding to the manual key-on timing. If key-off timing of a given automatic performance note is within another predetermined allowable difference from given manual key-on timing and if a tone based on the note has not yet been generated, that tone is generated at timing corresponding to the manual key-on timing. If a single key depression is executed when a plurality of automatic performance notes are to be sounded simultaneously, these notes can be sounded in response to that single key depression. If a plurality of key depressions are executed within a predetermined short time, automatic performance notes are sounded in response to the earliest key depression. Automatic performance data are generated separately for right-hand and left-hand performances, in response to which the keyboard keys are divided at a variable key split point into two key ranges, so that a tone is generated based on the performance data for right-hand or left-hand performance depending on which of the two key ranges are used to depress a corresponding key.

21 Claims, 15 Drawing Sheets

AUTOMATIC PERFORMANCE DEVICE AND METHOD CAPABLE OF A PRETENDED MANUAL PERFORMANCE USING AUTOMATIC PERFORMANCE DATA

BACKGROUND OF THE INVENTION

The present invention relates generally to automatic performance devices and methods for sequentially reading out prestored automatic performance data from memory to generate tones on the basis of the read-out automatic performance data. More particularly, the present invention relates to an automatic performance device and method providing for a pretended manual performance by setting or adjusting tone generating timing based on automatic performance data in response to player's operation on a manual performance operator such as a keyboard.

Examples of the conventionally known automatic performance device for automatically generating tones includes one that is designed to generate a tone by reading one performance data in response each key operation by a human player (so-called "one-key playing"). In another example of the known automatic performance device, performance data are sequentially read out in accordance with a predetermined tempo, independently of player's key operation, so that tones are generated on the basis of the so-far-read-out performance data in response player's activation of a predetermined key. According to such a scheme, the predetermined key is either a particular key on a keyboard or a dedicated key provided separately from the keyboard. Generally, concurrently with the tone generation based on the activation of the key, the device can execute an automatic performance for another part at a predetermined tempo.

However, with the first-said known automatic performance device, the performance would often become stagnant or too fast such as when the player fails to operate the keys in an appropriate manner, resulting in misharmonization with another automatically-performed part. Thus, the human player or operator can not enjoy a musical performance. With the second-said known automatic performance device, which can prevent the performance from becoming stagnant or too fast, the player has to operate the key with a single finger because the particular keyboard key or dedicated key is used as a tone generation controlling key, so that the player, during performance, can not have a feeling as if he or she were actually performing with both hands. Also, a right-hand performance part (e.g., melody) and a left-hand performance part (e.g., chord accompaniment) can not be carried out independently of each other by operating the keyboard with both hands on the basis of performance data for the two performance parts.

SUMMARY OF THE INVENTION

It is therefore an object of the present invention to provide an automatic performance device and method which, by a human player or operator just activating a particular performance operator, can execute a musical performance in such a manner as if the operator were actually carrying out desired performance operation.

According to a first aspect of the present invention, there is provided an automatic performance device which comprises: an automatic performance data supplying section that supplies automatic performance data in accordance with a set performance tempo, the automatic performance data including information indicative of at least a note and a key-on event; a manual performance data supplying section that supplies manual performance data in response to performance operation by a human player, the manual performance data including information indicative of at least a note and a key-on event; and a control unit that if key-on event timing of a given note of the automatic performance data is within a predetermined allowable time difference from key-on event timing of the manual performance data and a tone corresponding to the given note remains to be generated, executes control such that generation of the tone corresponding to the given note should start at a time point corresponding to the key-on event timing of the manual performance data.

The automatic performance data are sequentially supplied in accordance with a predetermined performance tempo and include pieces of note information each indicative of automatic performance tones to be generated and pieces of key-on event information each instructing start of generation of the tone to be generated. Typically, for muting, i.e., deadening each note being sounded, the automatic performance data further include note information and key-off event information instructing deadening of the note. Depending on the specifications applied (as in the case where a generated tone is controlled using a decaying envelope), the automatic performance data may not include the key-off event information; the application of such automatic performance data are also within the scope of the present invention. The manual performance data are generated by human player's performance operation, such as key depression and key release where a keyboard is employed as a performance operator, and the manual performance data are supplied completely separately from the automatic performance data. Thus, the control unit in the present invention controls sounding (audible reproduction) of the automatic performance data by comparing at least generation timing of a key-on event (key-on event timing) indicated by the manual performance data supplied by the manual performance data supplying section and at least generation timing of a key-on event (key-on event timing) indicated by the automatic performance data supplied by the automatic performance data supplying section. Of course, where the automatic performance data are arranged to include key-off information, it is preferable that the sounding of the automatic performance data be control in consideration of generation timing of a key-off event (key-off event timing) as well. Note that in this specification, the terms "key-on" and "key-off" do not necessarily refer to on/off operation of actual key switches; that is, each instruction or on-trigger for start of generation of a tone is called a "key-on" event while each instruction or off-trigger for muting or deadening of a tone is called a "key-off" event.

Because the manual performance data are generated in player's real-time performance operation, it is possible to generate manual performance data, well reflecting player's intention, in correspondence with tone generation timing of an automatic performance, by the player executing key depression and key release while intentionally associating the key operation with the automatic performance data. Thus, the present invention controls generation of tones of the note information included in the automatic performance data in accordance with the manual performance data, taking into account key-on and key-off event timing of these data. In this manner, even where the human player or operator is unable to play a keyboard-type musical instrument, control can made such that tones of accurate notes agreeing with the automatic performance data are automatically generated at right timing corresponding to manual performance operation, by the player just depressing any desired key.

Therefore, the automatic performance device of the present invention can advantageously function as a performance aiding device for inexperienced or beginner-class players. Further, when applied to beginner-class performance practice, which may include practice centering on accurate reproductive performance of predetermined notes and practice centering on reproduction of rhythms, the inventive automatic performance device can advantageously function for the rhythm reproducing practice. Further, because the inventive automatic performance device can control the tone generation in response to player's manual performance operation, the player can feel as if the player were actually performing all notes and people observing the performance would think that the player is actually performing all notes. Thus, with the automatic performance device, every player and observer can enjoy a satisfactory musical performance.

In a preferred implementation, when a key-on event of the manual performance data occurs between a first predetermined time point before occurrence of a key-on event of the automatic performance note and a second predetermined time point after occurrence of a key-off event of the automatic performance note, the control unit instructs start of generation of a tone based on the automatic performance note at a time point corresponding to occurrence of the key-on event of the manual performance data. The following description will be made on the assumption that the manual performance data supplying section manually operated by the player is a keyboard. When a key-on event of the manual performance data occurs, in response to player's depression of a keyboard key, within a first predetermined period before occurrence of a key-on event of the automatic performance note, namely, when the key depression has been made within the first predetermined period before occurrence of a key-on event of the automatic performance data, the device starts generation of a tone based on the automatic performance note. Further, when a key-on event of the manual performance data occurs between occurrence of a key-on event of the automatic performance note and occurrence of a key-off event of the automatic performance note, namely, when the key depression has been made during a predetermined sounding period of the automatic performance note, the the control unit instructs start of generation of a tone based on the automatic performance note. These are normal operation taking place when the player's key depression generally in conformity with predetermined reproduction timing of the automatic performance note. Also, when a key-on event of the manual performance data occurs, in response to player's depression of a keyboard key, within a second predetermined period after occurrence of a key-off event of the automatic performance note, namely, when the key depression has been made immediately after occurrence of a key-off event of the automatic performance note rather than during key-on of the automatic performance data, the the control unit instructs start of generation of a tone based on the automatic performance note as long as the key depression is within the second predetermined period after occurrence of the key-off event of the automatic performance note. In these cases, generation of the tone based on the automatic performance note is initiated at key-on timing corresponding to the player's performance operation; however, in other cases, the automatic performance would be wasted and no tone is generated therefor. Process to mute or deaden the tone based on the automatic performance note may be executed at a time point corresponding to key-off timing of the automatic performance data, i.e., in response to player's key release operation.

In some cases, the automatic performance data include key-on events of a plurality of notes occurring practically simultaneously such as components of a chord, and it is important to find an appropriate approach for controlling sounding of these notes in accordance with manual performance data. From a view point of player's manual key depression for the above-mentioned purposes, it should be more preferable to allow the player to freely depress any one or more desired keys, rather than to set strict limitations that the player should depress a single predetermined key. Such free key depression could provide for an enjoyable performance since it is much easier and gives a feeling as if the player were executing an actual performance. It thus becomes important to find an appropriate approach for controlling tone generation when there occur key-on events of a plurality of manual performance data practically simultaneously. Namely, when there occur key-on events of a plurality of automatic performance notes practically simultaneously or when there occur key-on events of a plurality of manual performance data practically simultaneously, good tone generation control would not be achieved by merely generating and deadening a tone, based on the automatic performance note, every key-on and key-off timing of the automatic performance data. For this reason, the inventor of the present invention proposes herein controlling the tone generation in consideration of not only particular key-on or key-off timing of an automatic performance note or manual performance data but also a key-on or key-off event of another automatic performance note or manual performance data occurring before or after the particular key-on or key-off timing.

To this end, when key-on events of first and second ones of the manual performance data occur in succession, at an interval smaller than a predetermined value, within a particular period including at least a time from occurrence of a key-on event to occurrence of a key-off event of the automatic performance note, the control unit may instruct start of generation of a tone based on the automatic performance note at a time point corresponding to occurrence of the key-on event of the first manual performance data, but executes control such that the tone based on the automatic performance note is not generated at a time point corresponding to occurrence of the key-on event of the second manual performance data. When key-on events of a plurality of manual performance data occur, i.e., when the player has depressed a plurality of keys in succession within a predetermined short time (at a predetermined short interval), tone generation is initiated in response to the first manual performance data, i.e., to the first key depression, and the other manual performance data following the first manual performance data, i.e., the second and subsequent key depression are ignored.

In another implementation, the control unit may be arranged in such a manner that when key-on events of first and second the manual performance data occur in succession, at an interval smaller than a predetermined value, within a particular period including at least a time from occurrence of a key-on event to occurrence of a key-off event of the automatic performance note, it instructs start of generation of a tone based on the automatic performance note at a time point corresponding to occurrence of the key-on event of the first manual performance data, but executes control such that the tone based on the automatic performance note is not generated at a time point corresponding to occurrence of the key-on event of the second manual performance data, and wherein when a key-off event of the first manual performance data occurs and then a key-off event of the second manual performance data occurs before occurrence of the key-off event of the automatic performance note, the control unit allows the generation of the tone based on the automatic performance note to continue even after occurrence of the key-off event of the first manual performance data and instructs deadening of the tone based on the automatic performance note at a time point corresponding to occurrence of the key-off event of the second manual performance data. When key-on events of a plurality of manual performance data occur, i.e., when the player has depressed a plurality of keys in succession within a predetermined short time (at a predetermined short interval), tone generation is initiated in response to the first manual performance data, i.e., to the first key depression, similarly to the above-noted implementation; however, when the first-depressed key is released and the second key is depressed before occurrence of a key-off event of the automatic performance data, the tone generation based on the first key depression is retained in response to the second key depression.

In still another implementation, the control unit may be arranged in such a manner that when key-on events of first and second the manual performance data occur in succession, at an interval greater than a predetermined value, within a particular period including at least a time from occurrence of a key-on event to occurrence of a key-off event of the automatic performance note, it instructs start of generation of a tone based on the automatic performance note at a time point corresponding to occurrence of the key-on event of the first manual performance data, then temporarily instructs deadening of the tone based on the automatic performance note at a time point corresponding to occurrence of the key-on event of the second manual performance data and then instructs restart of generation of the tone. The control unit functions in the above-mentioned manner when the player has depressed a plurality of keys in succession at an interval greater than a predetermined value. In this case, tone generation is initiated in response to the first manual performance data, i.e., to the first key depression, similarly to the above-noted implementation, and once the second key has been depressed, the tone generation based on the first key depression is terminated so as to initiate tone generation based on the second key depression.

In still another implementation, the control unit may be arranged in such a manner that when key-on events of a plurality of automatic performance notes occur within a predetermined period, the control unit considers the automatic performance notes to be components of a chord and executes control such that generation of tones based on the automatic performance notes remaining to be generated before occurrence of a key-on event of the manual performance data should simultaneously start at a time point corresponding to occurrence of the key-on event of the manual performance data. In this case, when key-on events of a plurality of automatic performance notes occur within a predetermined short period, the control unit judges the automatic performance notes as pertaining to a chord performance and executes tone generation corresponding to the chord performance in response to the player's key depression. When there occurs a key-on event based on player's key depression after occurrence of all key-on events of a plurality of automatic performance notes pertaining to a chord performance, all these automatic performance notes are sounded simultaneously. However, when there occurs a key-on event based on player's key depression before occurrence of any one of key-on events of a plurality of automatic performance notes pertaining to a chord performance, one or more tones (chord-component tones) are generated on the basis of one or more of the automatic performance notes for which key-on events have already occurred and which remain to be sounded.

According to another aspect of the present invention, there is provided an automatic performance device which comprises: an automatic performance data supplying section that supplies automatic performance data for right-hand performance and left-hand performance in accordance with a set performance tempo, the automatic performance data including information indicative of at least a note and a key-on event; a manual performance section that supplies manual performance data in response to performance operation by a human player, the manual performance data including information indicative of at least a note and a key-on event; a split-point setting section that variably sets a split point for dividing the manual performance section into two note ranges on the basis of note information included in the automatic performance data for right-hand performance and left-hand performance supplied by the automatic performance data supplying section; a determining section that, on the basis of note information included in the manual performance data supplied by the manual performance section, makes a determination as to which of the two note ranges the manual performance data belong to and selects either of the automatic performance data for right-hand performance and the automatic performance data for left-hand performance in correspondence with the manual performance data on the basis of a result of the determination; and a control unit that controls generation of a tone based on the note information included in the automatic performance data selected by the determining section, in accordance with key-on timing of the manual performance data.

The automatic performance data for right-hand performance and left-hand performance are supplied in accordance with a set performance tempo. The split-point setting section variably sets a key split point between two note ranges, i.e., key ranges, on the basis of note information included in the automatic performance data for right-hand performance (e.g., information indicative of a lowest-pitch note) and the automatic performance data for left-hand performance (e.g., information indicative of a highest-pitch note). As the lowest-pitch note and highest-pitch note represented by the respective note information in the right-hand and left-hand automatic performance data along with progression of an automatic performance, the split-point setting section variably sets a key split point. The determining section compares the note information included in the manual performance data from the manual performance section and the key split point so as to determine in which of the right-hand and left-hand key ranges key depression or key release took place to generate the manual performance data, and then selects either of the automatic performance data for right-hand performance and the automatic performance data for left-hand performance in correspondence with the manual performance data on the basis of a result of the determination. Then, the control unit that controls generation of a tone based on the note information included in the automatic performance data selected by the determining section, in accordance with key-on timing of the manual performance data. In this manner, although only one key-board is employed, it is possible to control tone generation based on the automatic performance data in such a manner corresponding to a both-hand performance method using two tracks. Namely, by prestoring the automatic performance data in such a manner corresponding to the both-hand performance method using two tracks and allowing the single keyboard to be used as two key ranges divided by the variable split point, the key ranges can be used separately for right-hand and left-hand performance notes of the automatic performance data. Because the key split point sequentially shifts from one position to another in accordance with progression of an automatic performance in stead of being constantly fixed, a performance can be executed with the key ranges varying in accordance with progression of a music piece, so that the inventive automatic performance allows the player to perform with a feeling as if the player were actually performing the music piece.

The principle of the present invention may be embodied as an automatic performance method as well as the automatic performance device as above. Also, the principle of the present invention may be embodied as a computer program and a recording medium storing such a computer program.

BRIEF DESCRIPTION OF THE DRAWINGS

For better understanding of the above and other features of the present invention, the preferred embodiments of the invention will be described in greater detail below with reference to the accompanying drawings, in which.

DETAILED DESCRIPTION OF THE PREFERRED EMBODIMENTS

Figure 2:
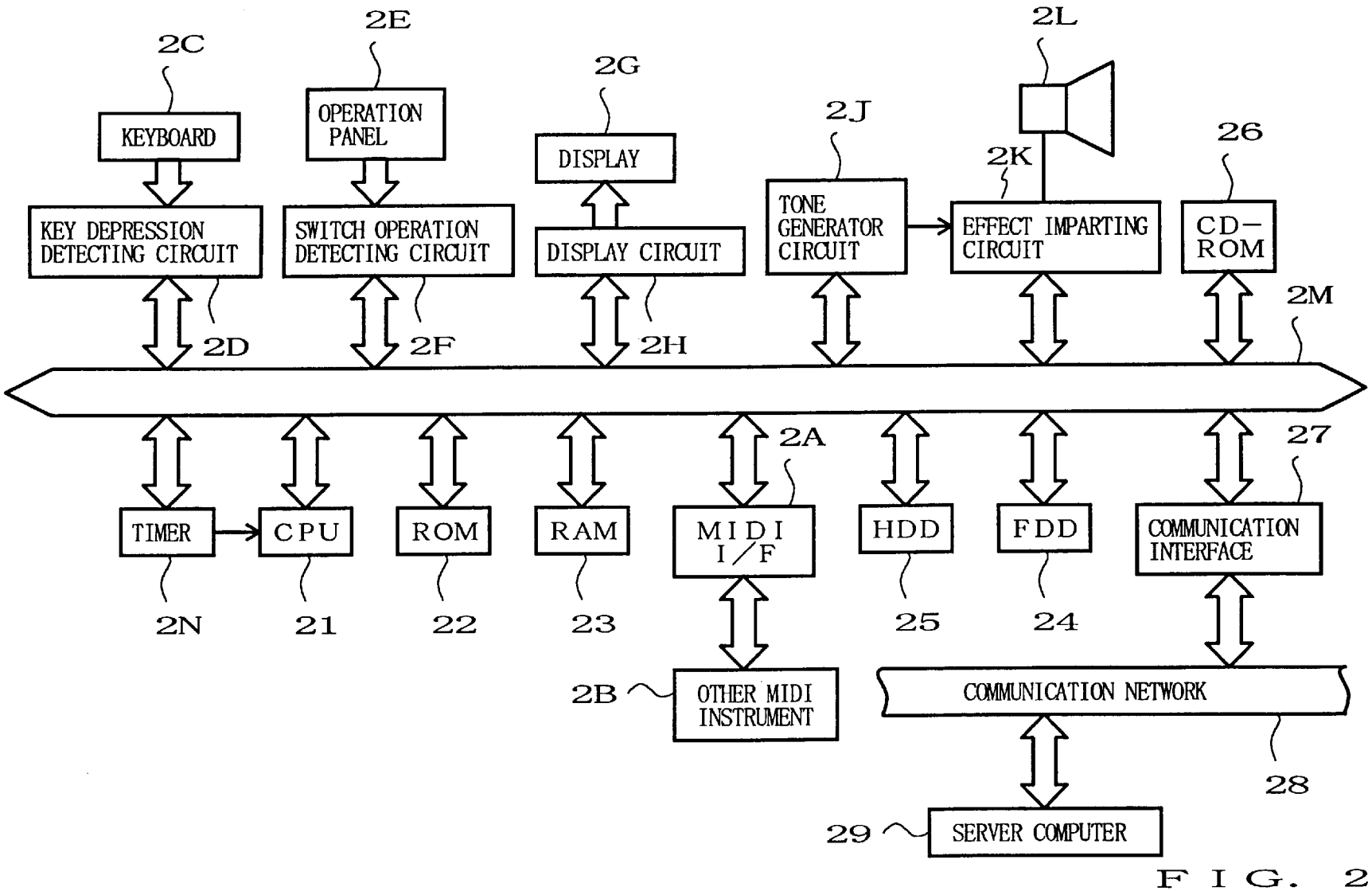
FIG. 2 is a block diagram illustrating a general hardware structure of the automatic performance device in accordance with a preferred embodiment of the present invention.

FIG. 2 is a block diagram illustrating a general hardware structure of an automatic performance device in accordance with a preferred embodiment of the present invention.

CPU 21 controls overall operation of the automatic performance device on the basis of various programs and data stored in a ROM 22 and RAM 23 as well as various tone control information (MIDI data) received from an external storage device. The automatic performance device according to the preferred embodiment will be described hereinbelow as employing a floppy disk drive 24, hard disk drive 25 or CD-ROM drive 26 as the external storage device, although any other external storage device, such as a MO (Magneto Optical) disk drive or PD (Phase change Disk) drive, may be employed. Further, various other information including tone control information may be received from a server computer on a connected communication network 28 via a communication network 27, and/or MIDI data may be received from another MIDI instrument 2B via a MIDI interface (I/F) 2A.

The CPU 21 also supplies a tone generator circuit 2J with MIDI data received from the external storage device or generated in response to key depressing operation on a keyboard 2C by a human player or operator (or user) so that the tone generator circuit 2J generates a tone on the basis of the supplied MIDI data. Alternatively, tone generating processing may be executed by use of an external tone generator.

The ROM 22, which is a read-only memory (ROM), has prestored therein various programs (including system and operating programs) and various data. The RAM 23, which is for temporarily storing data (such as automatic performance data) generated as the CPU 21 executes a program, is provided in predetermined address regions of a random access memory (RAM) and used as registers, flags, buffers, tables, etc.

Further, although not specifically shown, the hard disk device 25 may store therein the operating program. By storing the operating program in the hard disk device 25 rather than in the ROM 22 and loading the operating program into the RAM 23, the CPU 21 can operate in exactly the same way as where the operating program is stored in the ROM 22. This arrangement greatly facilitates version-up of the operating program, addition of a new operating program, etc. A CD-ROM or floppy disk may be used as a removably-attachable external recording medium for recording various data, such as automatic performance data, chord progression data, tone waveform data and image data, and an optional operating program. Such an operating program and data stored in the CD-ROM or floppy disk can be read out by the CD-ROM drive 26 or floppy disk drive 24 to be then transferred for storage in the hard disk device 25. This arrangement also facilitates installation and version-up of the operating program.

The communication interface 27 may be connected to a data and address bus 2M of the automatic performance device so that the device can be connected via the interface 27 to a desired communication network such as a LAN (Local Area Network) and Internet to exchange data with an appropriate sever computer 29. Thus, in a situation where the operating program and various data are not contained in the hard disk device 25, these operating program and data can be downloaded from the server computer 29. In such a case, the automatic performance device, which is a "client" tone generating device, sends a command requesting the server computer 29 to download the operating program and various data by way of the communication interface 27 and communication network 28. In response to the command, the server computer 29 delivers the requested operating program and data to the automatic performance device via the communication network 28. The automatic performance device receives the operating program and data via the communication interface 27 and accumulatively store them into the hard disk device 25. In this way, the necessary downloading of the operating program and various data is completed.

Automatic performance data are prestored in the ROM 22, hard disk, CD-ROM, floppy disk or the like, and an automatic performance is executed by reading the prestored automatic performance data into the RAM 23 and then audibly reproducing the data. The automatic performance data are recorded in a plurality of recording tracks, two of which are allocated as guide tracks. The performance data in the guide tracks are for performance by both hands on a keyboard-type musical instrument such as a piano; that is, the performance data in one of the guide tracks are for right-hand manual performance (R) while the performance data in the other guide track are for left-hand manual performance (L). In the recording tracks other than the performance guide tracks, there are recorded automatic performance data for other musical instruments. As will be later described in detail, the automatic performance device carries out a performance based on the performance data stored in these guide tracks.

The automatic performance data in each of the recording tracks include key-on data, key-off data, duration data and other data that are recorded in order of predetermined performance progression. The key-on data indicates a start of generation of a tone and includes data such as a note number and velocity value, and the key-off data indicates an end of generation of a tone and includes data such as a note number. The duration data indicates timing to generate key-on, key-off or other data and is expressed by a time interval between two successive data. The other data includes data concerning a tone color (timbre), tone volume and tonal effect.

The keyboard 2C, which is connected to a key depression detecting circuit 5, has a plurality of keys for designating a pitch of a tone to be generated and key switches provided in corresponding relations to the keys. Depending on an application intended, the keyboard 2C may also include a key-touch detecting means such as a key-depression velocity (or force) detecting device. Any other performance operator may be employed in the automatic performance device in place of or in addition to the keyboard 2C, although the automatic performance device will be described here as employing the keyboard 2C since the keyboard is a fundamental performance operator easy to understand.

The key depression detecting circuit 2D, which comprises a plurality of key switch circuits corresponding to the keys on the keyboard 2C, outputs a key-on event signal upon detection of each newly depressed key and a key-off event signal upon detection of each newly released key. The key depression detecting circuit 2D also generates velocity data and after-touch data by determining a key-depression velocity or force.

Operation panel 2E including ten-keys and keyboard is connected to a switch operation detection circuit 2F which detects operational states of various switches and operators on the operation panel 2F to output switch event signals corresponding to the detected states.

Specifically, on the operation panel 2F, there are provided style selecting switches, song selecting switches a start/stop switch, etc., as well as operators for selecting, setting and controlling a color, volume, pitch, effect, etc. of each tone to be generated. Although the operation panel 2F includes a multiplicity of other operators, these other operators are not part of the present invention and will not be described herein in detail. The style selecting and song selecting switches are for entering digits "0" to "9" and signs "+" and "−" so that numbers of a desired style and song can be selected by activating some of these switches. Style number (name) and song number selected using the style selecting and song selecting switches are visually presented on a display 2G that is preferably disposed on the front surface of the keyboard. The start/stop switch turns on or turns off an automatic performance each time it is activated.

Display circuit 2H controls the display 2G to show various information such as a musical staff of a song to be automatically performed or a piano roll staff corresponding to the musical staff.

The tone generator circuit 2J is capable of simultaneously generating tone signals in a plurality of channels. The tone generation channels to simultaneously generate tone signals in the tone generator circuit 2J may be implemented by using a single circuit on a time-divisional basis or by providing a separate circuit for each of the channels. Any tone signal generation method may be used in the tone generator circuit 2J depending on an application intended. For example, any conventionally known tone signal generation method may be used such as: the memory readout method where tone waveform sample value data stored in a waveform memory are sequentially read out in accordance with address data that vary in accordance with a pitch of a tone to be generated; the FM method where tone waveform sample value data are obtained by performing predetermined frequency modulation operations using the above-mentioned address data as phase angle parameter data; or the AM method where tone waveform sample value data are obtained by performing predetermined amplitude modulation operations using the above-mentioned address data as phase angle parameter data. Other than the above-mentioned, the tone generator circuit 2J may also use the physical model method where a tone waveform is synthesized by algorithms simulating a tone generation principle of a natural musical instrument; the harmonics synthesis method where a tone waveform is synthesized by adding a plurality of harmonics to a fundamental wave; the formant synthesis method where a tone waveform is synthesized by use of a formant waveform having a specific spectral distribution; or the analog synthesizer method using VCO, VCF and VCA. Further, the tone generator circuit 2J may be implemented by a combined use of a DSP and microprograms or of a CPU and software programs, rather than by dedicated hardware.

Timer 2N generates tempo clock pulses for measuring a time interval or setting a tempo of an automatic performance. Frequency of the tempo clock pulses can be adjusted by means of a tempo switch (not shown) provided on the operation panel 2E. Each of the tempo clock pulses is given to the CPU 21 as an interrupt instruction, in response to which the CPU 21 interruptively carries out various operations for an automatic performance. This embodiment will be described on the assumption that 96 tempo clock pulses are generated per quarter note.

Effect imparting circuit 2K imparts any of various effects to a tone signal generated by the tone generator circuit 2J, so that the effect-imparted tone signal is delivered to a sound system 2L for audible reproduction or sounding through an amplifier and speaker.

Now, a description will be made about exemplary behavior of the automatic performance device in accordance with the present invention.

Figure 12:
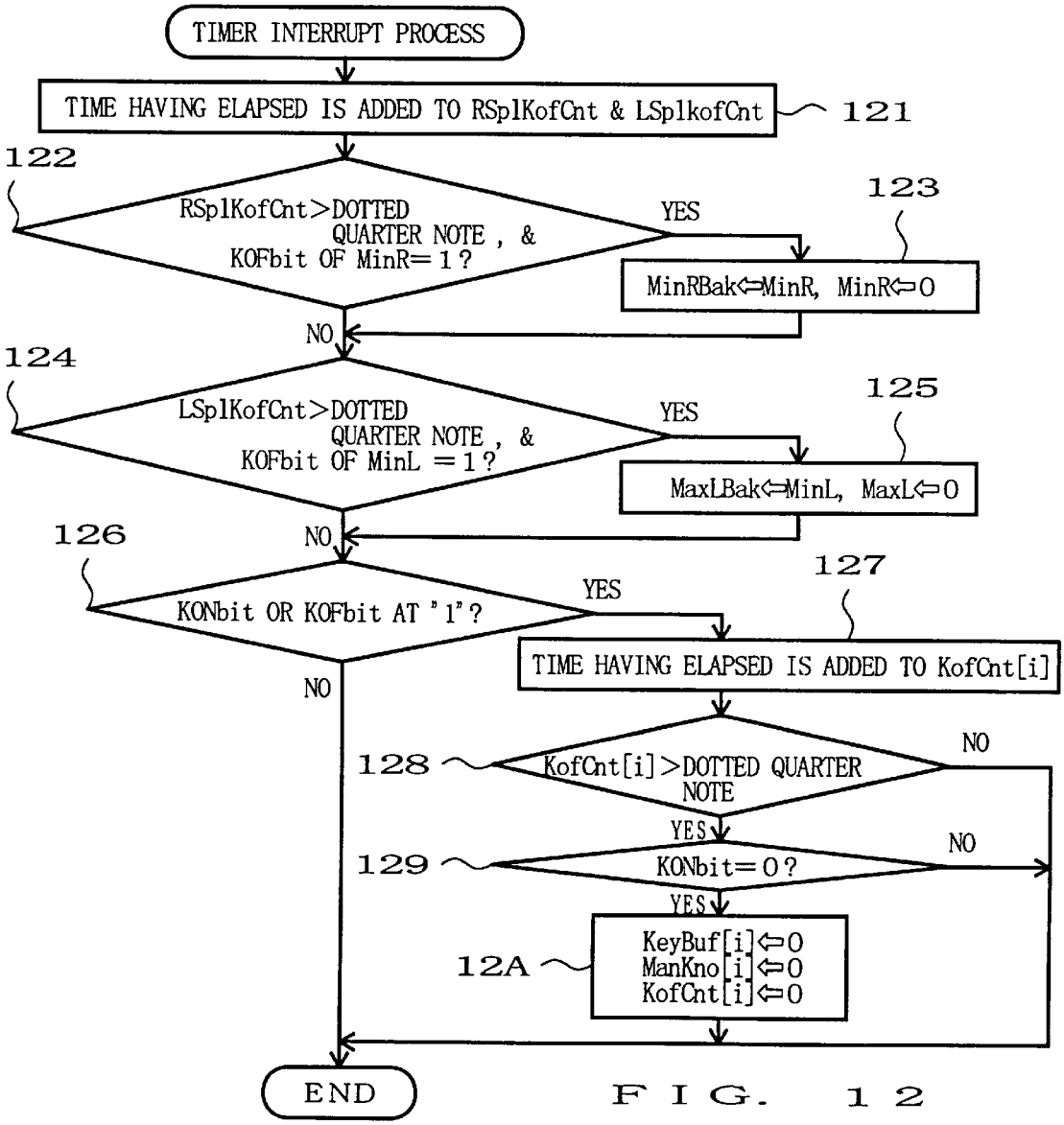
FIG. 12 is a flow chart illustrating an exemplary step sequence of a timer interrupt process that is carried out by the automatic performance device of the invention.

FIGS. 3 to 7 are flow charts illustrating exemplary steps of performance-data reproducing processing that is carried out by the automatic performance device, FIGS. 8 to 11 are flow charts illustrating exemplary steps of manual performance processing that is carried out by the automatic performance device in response to human player's manual performance operation, and FIG. 12 is a flow chart illustrating exemplary steps of a timer interrupt process that is carried out by the automatic performance device.

First, the following paragraphs describe various buffer registers and flags that are provided in the RAM 23 and used in the above-mentioned various processing.

There are a total of 16 key buffers KeyBuf each for storing a note number, and if a value "o" is present in the key buffer KeyBuf[i], it indicates that no note number is stored therein. Variable "i" attached to the reference character KeyBuf takes a value in the range of "0" to "15".

Once a given note stored in the key buffer KeyBuf[i] is been sounded or audibly reproduced, manual performance buffer ManKno[i] stores a unique key number of the key having been depressed to trigger the sounding.

Time counter KofCnt[i] counts a time having elapsed from occurrence of each key-on or key-off event.

Each of the key buffers KeyBuf[i] includes 5-bit flags: key-on flag KONbit; clearance wait flag CLRbit; key-off flag KOFbit; ahead-of-timing sounding flag PREbit; and guide flag LRbit. The key-on flag KONbit indicates whether a tone of a note number stored in one of the key buffers KeyBuf[i] corresponding to the variable "i" is being currently sounded or not; that is, when the key buffer KeyBuf[i] is at a value "1", it means that the tone of the stored note number is being currently sounded, but when the key buffer KeyBuf[i] is at a value "0", it means that the tone of the stored note number is not being currently sounded. The clearance wait flag CLRbit indicates that the automatic performance device is waiting for the key buffer KeyBuf[i] to be reset, when the tone of the tone number is being currently sounded (i.e., the key-on flag KONbit is currently at "1") and thus the key buffer KeyBuf[i] can not be reset at once. That is, when the automatic performance device is waiting for the key buffer KeyBuf[i] to be reset, "1" is set into the clearance wait flag CLRbit; otherwise "0" is set into the clearance wait flag CLRbit. The key-off flag KOFbit is set to "1" when key-off timing arrives during reproduction of the tone of the note number stored in the key buffer KeyBuf[i]. The ahead-of-timing sounding flag PREbit is set to "1" when a tone of a particular note number is sounded ahead of its predetermined reproduction or sounding timing and reset to "0" once the predetermined reproduction timing has arrived. The guide flag LRbit indicates whether data stored in the key buffer KeyBuf[i] pertains to the right-hand performance guide track or to the left-hand performance guide track. If the data pertains to the right-hand performance guide track, the guide flag LRbit is set to "0", but if the data pertains to the left-hand performance guide track, the guide flag LRbit is set to "1".

Highest-pitch note buffer MaxL and lowest-pitch note buffer MinR are used to calculate a key split point. Specifically, the highest-pitch note buffer MaxL stores therein a highest-pitch note of all note numbers stored in the key buffers KeyBuf[1]–KeyBuf[15] in relation to the left-hand performance guide track, and the lowest-pitch note buffer MinR stores therein a lowest-pitch note of all note numbers stored in the key buffers KeyBuf[1]–KeyBuf[15] in relation to the right-hand performance guide track.

As the highest-pitch note buffer MaxL and lowest-pitch note buffer MinR are reset to "0" upon lapse of the time corresponding to a dotted quarter note, a highest-pitch-note backup buffer MaxLBak and lowest-pitch-note backup buffer MinRBak store note numbers having so far been stored in the respective note buffers MaxL and MinR.

Right-hand key-on counter RKonCnt and left-hand key-on counter LKonCnt are provided for counting the numbers of note-on events in the respective performance guide tracks and incremented by one in response to occurrence of each key-on event and decremented by one in response to occurrence of each key-off event. Thus, if there is no key-on event in the corresponding performance guide track, then each of the right-hand key-on counter RKonCnt and left-hand key-on counter LKonCnt remains at the "0" count.

Right-hand time counter RSplKofCnt and left-hand time counter LSplKofCnt are each provided for counting a time having elapsed after the respective right-hand key-on counter RKonCnt and left-hand key-on counter LKonCnt are reset to "0".

Key-on duration buffer KonDur is provided for storing therein a value of duration data and used to determine whether or not a current performance is a chord performance. This key-on duration buffer KonDur is reset to "0" when the counted duration has become greater than the time corresponding to a dotted thirty-second note.

Finally, duration counter DurCnt is provided for counting duration.

In the performance data reproducing processing shown in FIGS. 3 to 7, the performance data are read out from the individual tracks in accordance with a set performance tempo. Once the performance data recorded in the guide tracks have been read out through automatic performance reproducing processing (not shown), the read-out performance data are written into various buffers. More specifically, the performance data stored in the guide tracks are read out ahead of those in the other recording tracks and temporarily stored in a pre-read buffer PreLdBuf. In effect, only key-on data, key-off data and duration data, of the performance guide tracks, to be used for performance guide purposes are temporarily stored in the pre-read buffer PreLdBuf and the other data, of the performance guide tracks, not to be used for performance guide purposes are not temporarily stored in the pre-read buffer PreLdBuf. Then, the performance data thus temporarily stored in the pre-read buffer PreLdBuf are read out in synchronism with the performance data of the other recording tracks, so that these read-out performance data are used in various operations as will be set forth below. For convenience of description, the performance data read out from the pre-read buffer PreLdBuf will hereinafter be called "reproduced data".

The manual performance processing shown in FIGS. 8 to 11 are designed to compare the reproduced data and performance data generated by the human player's manual performance operation on the keyboard 2C, so as to audibly reproduce the reproduced data only when they are determined as optimum. For convenience of description, the performance data generated by the manual performance will hereinafter be called "manual performance data".

Namely, the automatic performance device according to the present embodiment generates a tone corresponding to given reproduced data only when the player executes accurate keyboard operation corresponding to the reproduced data. If the player has failed to execute accurate keyboard operation corresponding to the reproduced data, such as when the player has depressed a wrong key or has depressed a key at wrong timing, the automatic performance device makes a comparison between the reproduced data and the manual performance data and carries out performance operations corresponding to the comparison result.

In the automatic performance device according to the embodiment, a selection can be made from three performance guide modes: right-hand guide mode; left-hand guide mode; and both-hand guide mode. In the right-hand guide mode, a tone based on reproduced data of the right-hand performance guide track will be generated in response to player's actual depression of any one key on the keyboard 2C. In the left-hand guide mode, a tone based on reproduced data of the left-hand performance guide track will be generated in response to player's depression of any one key on the keyboard 2C. In each of the right-hand and left-hand guide modes, such a tone can be generated irrespective of the position (pitch) of the depressed key on the keyboard 2C. In the both-hand guide mode, a key split point is set on the basis of the automatic performance data read out from the two performance guide tracks. According to the present embodiment, the key split point will vary successively as the performance progresses. If the key depressed by the player is to the right of the split point, a tone based on reproduced data of the right-hand performance guide track will be generated, but if the key depressed by the player is to the left of the split point, a tone based on reproduced data of the left-hand performance guide track will be generated.

Note that in the right-hand guide mode, the data of the left-hand performance are automatically performed, similarly to the data of the other recording tracks, without requiring actual key depression by the player. Likewise, in the left-hand guide mode, the data of the right-hand performance are automatically performed without requiring actual key depression by the player.

Figure 3:
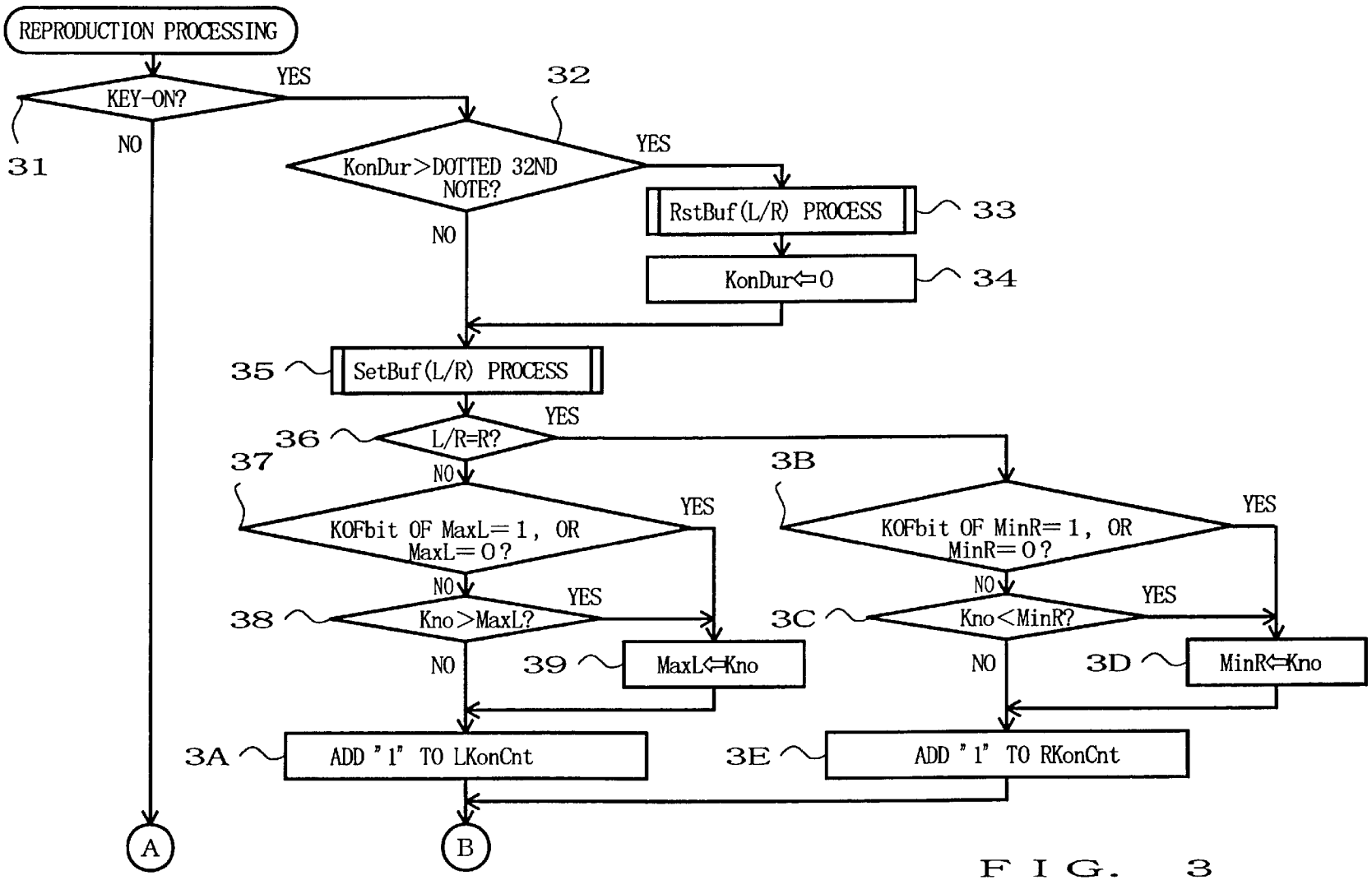
FIG. 3 is a flow chart illustrating a former half of an exemplary step sequence of performance data reproduction processing that is carried out by the automatic performance device of the invention.
Figure 4:
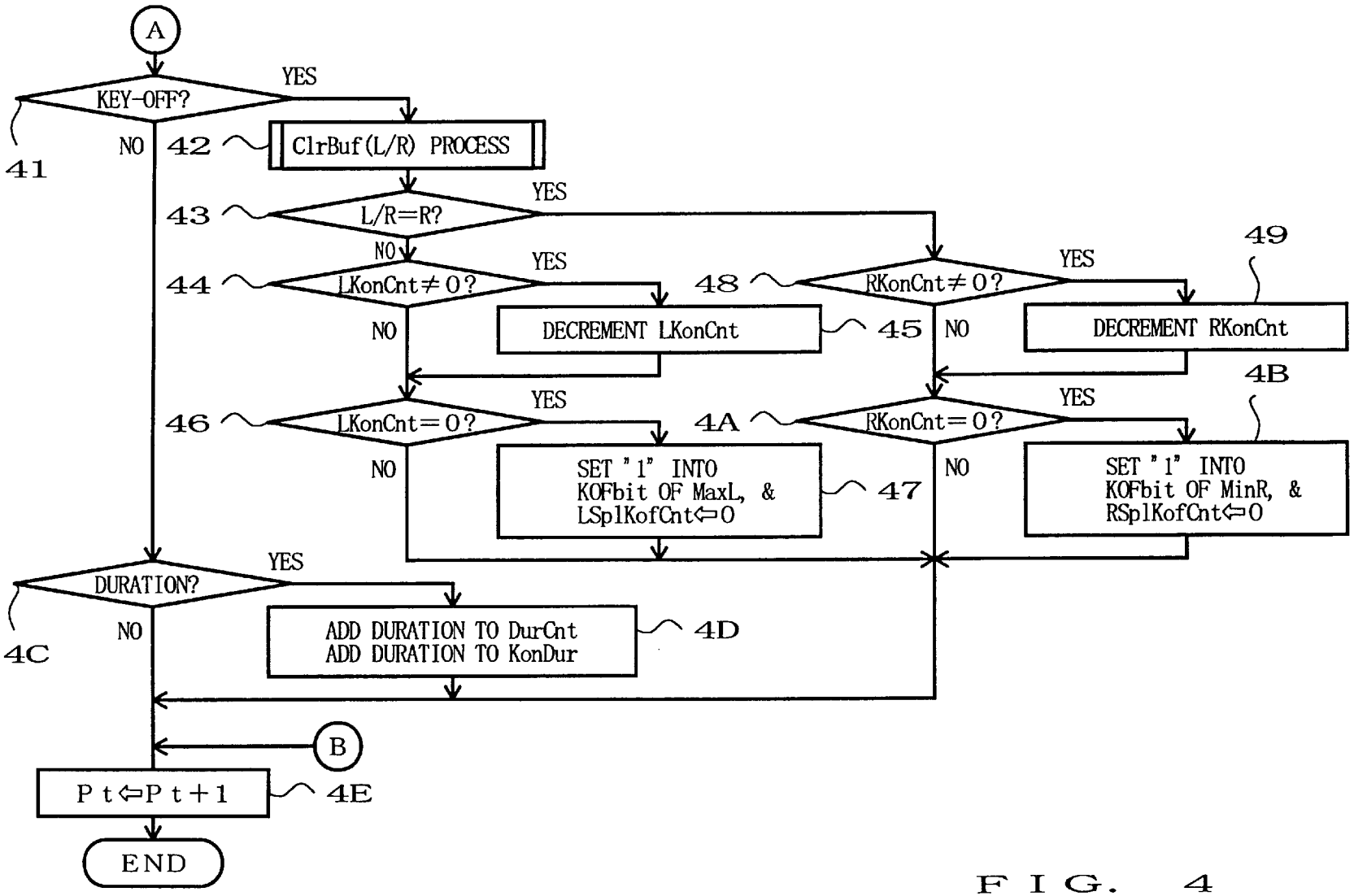
FIG. 4 is a flow chart illustrating a latter half of the exemplary step sequence of the performance data reproduction processing.

First, a description will be made about the reproducing processing with reference to FIGS. 3 to 7. FIG. 3 is a flow chart illustrating a former half of the performance data reproduction processing, and FIG. 4 is a flow chart illustrating a latter half of the performance data reproduction processing. Performance data are sequentially read out from the individual tracks through the automatic performance reproducing processing (not shown), to carry out predetermined tone reproduction processing. At that time, the performance data of any one of the performance guide tracks are pre-read, i.e., read out, earlier that those of the other recording tracks by the time corresponding to a thirty-second note, for subsequent processing.

First, through steps 31, 41 and 4C, it is determined which of key-on, key-off and duration data the reproduced data read out from the performance guide track is. If the reproduced data read out from the performance guide track is key-on data, control proceeds to step 32; if the reproduced data is key-off data, control proceeds to step 42; and if the reproduced data is duration data, control proceeds to step 4D.

Specifically, the following operations take place when the read-out reproduced data has been identified as key-on data at step 31. In this case, a determination is first made as to whether or not a stored value in a key-on duration buffer KonDur is greater than the value corresponding to a dotted thirty-second note. Assuming that a quarter note is represented by a value "96", the value corresponding to a dotted thirty-second note is "18". Therefore, in this case, step 32 determines whether or not stored value in the key-on duration buffer KonDur is greater than "18". At this step 31, it is ascertained whether or not the reproduced key-on data pertains to a chord performance, because if the reproduced key-on data pertains to a chord performance, a plurality of key-on data for the chord performance have to be generated in response to a single key depression operation in this embodiment.

Thus, if the stored value in the key-on duration buffer KonDur is greater than the above-mentioned value corresponding to a dotted thirty-second note, the reproduced data is determined as not pertaining to a chord, so that a buffer resetting process (RstBuf (L/R)) is carried out in step 33.

Figure 5:
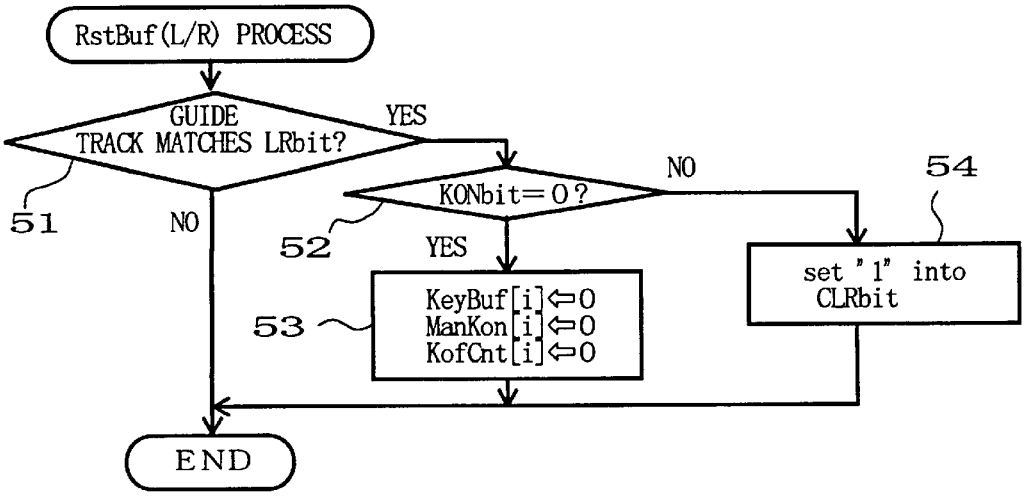
FIG. 5 is a flow chart illustrating exemplary details of a buffer resetting process in the performance data reproduction processing of FIG. 3.

FIG. 5 is a flow chart illustrating exemplary details of the buffer resetting process (RstBuf (L/R)) that is executed when the reproduced data does not pertain to a chord performance. Specifically, at step 51, a determination is made as to whether the performance guide track from which the reproduced data (key-on data) has been read out coincides with or matches that indicated by the guide flag LRbit of the key buffer KeyBuf[i]. If answered in the affirmative (YES) at step 51, control goes to step 52, but if not (NO), proceeds to step 34 of FIG. 3. Even when the performance guide track from which the reproduced data (key-on data) has been read out coincides with that indicated by the guide flag LRbit, the key buffer KeyBuf [i] can not be cleared during sounding of the stored key-on data, and thus it is ascertained at step 52 whether the key-on flag KONbit is currently at "0". If the key-on flag KONbit is currently at "0", the key buffer KeyBuf[i], manual performance buffer ManKno[i] and time counter KofCnt[i] are each reset to "0". If, on the other hand, the key-on flag KONbit is currently at "1", the clearance wait flag CLRbits set to "1", at step 54, in order to indicate that the device is waiting for the key buffer KeyBuf[i], manual performance buffer ManKno[i] and time counter KofCnt[i] to be reset.

Although not specifically shown, the buffer resetting process of FIG. 5 is looped for all of the key buffers KeyBuf[0]–[15]. After the reset buffer process, the key-on duration buffer KonDur is reset to a value "0".

Figure 6:
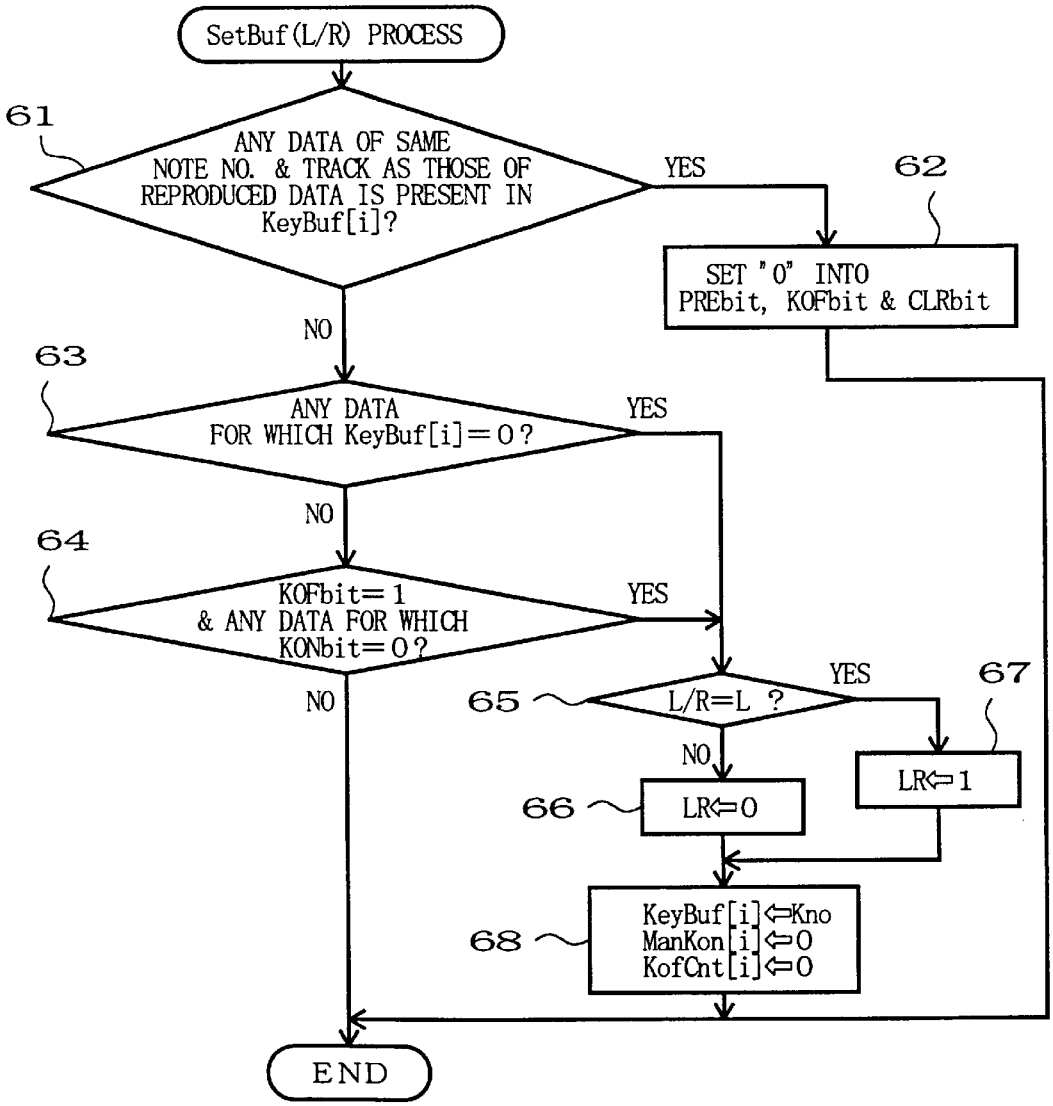
FIG. 6 is a flow chart illustrating exemplary details of a buffer setting process in the performance data reproduction processing of FIG. 3.

At step 35 of FIG. 3, a buffer setting process (SetBuf (L/R)) is carried out to store data into various buffers in relation to the read-out key-on data. FIG. 6 is a flow chart illustrating exemplary details of the buffer setting process of step 35, which is intended to compare the read-out reproduced data (key-on data) and stored data in the key buffer KeyBuf[i] and various flags and then carry out operations corresponding to the comparison result. At step 61, a determination is made as to whether data of the same note number and performance guide track as those of the reproduced data is present in the key buffer KeyBuf[i]. If answered in the affirmative (YES) at step 61, control goes to step 62 to set a value "0" to the ahead-of-timing sounding flag PREbit, key-off flag KOFbit and clearance wait flag CLRbit. If answered in the negative (NO) at step 61, control proceeds to step 63 to determine whether there is any key buffer KeyBuf[i] storing no data. With a negative determination at step 63, control moves on to step 64 in order to further determine whether there exists any data for which the key-off flag KOFbit is currently "1" and the key-on flag KONbit is currently at "0". If an affirmative (YES) determination results at step 63 or 64, a determination is made at step 65 as to whether the reproduced data is from the right-hand performance guide track or from the left-hand performance guide track, and data indicative of "right hand" or "left hand" is written into the guide flag LRbit at step 66 or 67 depending on the determination result of FIG. 65. Then, at step 68, the note number Kno of the reproduced data is set into one of the empty key buffers KeyBuf[i], and the manual performance buffer ManKno[i] and time counter KofCnt[i] are set to a value "0".

Although not specifically shown, the buffer setting process of FIG. 6 is also looped for all of the key buffers KeyBuf[0]–[15] and the process gets out of the looping when an affirmative (YES) determination results at any of steps 61, 63 and 64.

At step 36 of FIG. 3, a determination is made as to whether the reproduced data is from the right-hand performance guide track or from the left-hand performance guide track. If the reproduced data is from the left-hand performance guide track as determined at step 36, operations for a left-hand performance guide are carried out at steps 37 to 3A. If the reproduced data is from the right-hand performance guide track, operations for a right-hand performance guide are carried out at steps 3B to 3E.

At step 37, a determination is made as to whether the key-off flag KOFbit corresponding to the highest-pitch note buffer MaxL associated with the left-hand performance guide track is currently at "1" or the highest-pitch note buffer MaxL is currently at "0". If answered in the affirmative at step 37, control goes to step 39; otherwise control proceeds to step 38. If the note number of the reproduced data (i.e., stored value in key number buffer Kno) is greater than the note number stored in the highest-pitch note buffer MaxL as determined at step 38, control goes to step 39. At step 39, the note number of the reproduced data (the stored value in the key number buffer Kno) is stored into the highest-pitch note buffer MaxL. Then, at step 3A, the left-hand key-on counter LKonCnt associated with the left-hand performance guide track is incremented by one.

At step 3B, a determination is made as to whether the key-off flag KOFbit corresponding to the lowest-pitch note buffer MinR associated with the right-hand performance guide track is currently at "1" or the lowest-pitch note buffer MinR is currently at "0". If answered in the affirmative at step 3B, control goes to step 3D; otherwise control proceeds to step 3C. If the note number of the reproduced data (i.e., stored value in key number buffer Kno) is smaller than the note number stored in the lowest-pitch note buffer MinR as determined at step 3C, control goes to step 3D. At step 3D, the note number of the reproduced data (the stored value in the key number buffer Kno) is stored into the lowest-pitch note buffer MinR. Then, at step 3E, the right-hand key-on counter RKonCnt associated with the right-hand performance guide track is incremented by one.

Thus, once a new note number is stored into the highest-pitch note buffer MaxL or lowest-pitch note buffer MinR, arithmetic operations are performed to calculate a key split point on the basis of the new note number, as will be later described in detail.

Although not specifically shown, the operations of steps 36 to 3E are also looped for all of the key buffers KeyBuf [0]–[15].

Figure 7:
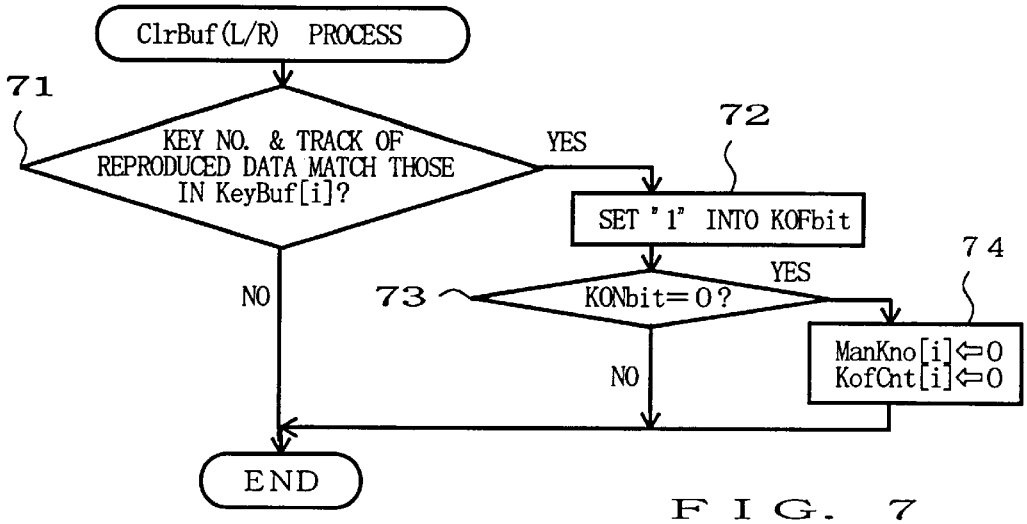
FIG. 7 is a flow chart illustrating exemplary details of a buffer clearing process in the performance data reproduction processing of FIG. 4.

The following operations take place at steps 42 to 4B when the reproduced data has been identified as key-off data at step 41. First, at step 42, a buffer clearing process (ClrBuf (L/R)) is carried out to clear data, pertaining to the key-off data, from various buffer. FIG. 7 is a flow chart illustrating exemplary details of the buffer clearing process (ClrBuf (L/R)) of step 42. In this buffer clearing process, a determination is first made at step 71 as to whether the key number and performance guide track of the read-out reproduced data coincide with those stored in the key buffer KeyBuf[i]. If answered in the affirmative (YES), control goes to step 72 in order to set "1" into the associated key-off flag KOFbit, and then it is determined at step 73 whether the key-on flag KONbit is currently at "0". If the key-on flag KONbit is currently at "1" as determined at step 73, then control proceeds to step 43, but if the key-on flag KONbit is at "0", control goes to step 43 after setting "0" into the manual performance buffer ManKno[i] and time counter KofCnt[i].

At step 43, a determination is made as to whether the reproduced data is from the right-hand performance guide track or from the left-hand performance guide track. If the reproduced data is from the left-hand performance guide track as determined at step 36, operations for a left-hand performance guide are carried out at steps 44 to 47. If the reproduced data is from the right-hand performance guide track, operations for a right-hand performance guide are carried out at steps 48 to 4B.

At step 44, it is ascertained whether the left-hand key-on counter LKonCnt associated with the left-hand performance guide track is not currently at "0". If the left-hand key-on counter LKonCnt is not at "0", i.e., an affirmative (YES) determination results at step 44, control goes to step 45 in order to decrement the counter LKonCnt by one, but if the left-hand key-on counter LKonCnt is at "0" (NO), control proceeds to step 46. At step 46, a determination is further made as to whether the left-hand key-on counter LKonCnt has reached the value of "0". If answered in the affirmative (YES) at step 46, control goes to step 47 in order to set "1" into the key-off flag KOFbit of the key buffer KeyBuf[i] corresponding to the highest-pitch note buffer Maxl and reset a left-hand time counter LSplKofCnt to "0".

At steps 48 to 4B, operations similar to steps 44 to 47 are performed on the buffer, flag and counter associated with the right-hand performance guide track.

Although not specifically shown, the operations of steps 43 to 4B are also looped for all of the key buffers KeyBuf [0]–[15].

The following operations take place when the reproduced data has been identified as key-off data at step 4C. In this case, the value of the duration data is added to the values of the duration counter DurCnt and key-on duration buffer KonDur, so that data readout and the like are executed by the automatic performance reproducing processing (not shown) on the basis of the duration counter DurCnt and key-on duration buffer KonDur. At step 4E, a data read pointer Pt of the pre-read buffer PreLdBuf(j) is incremented by one.

Figure 8:
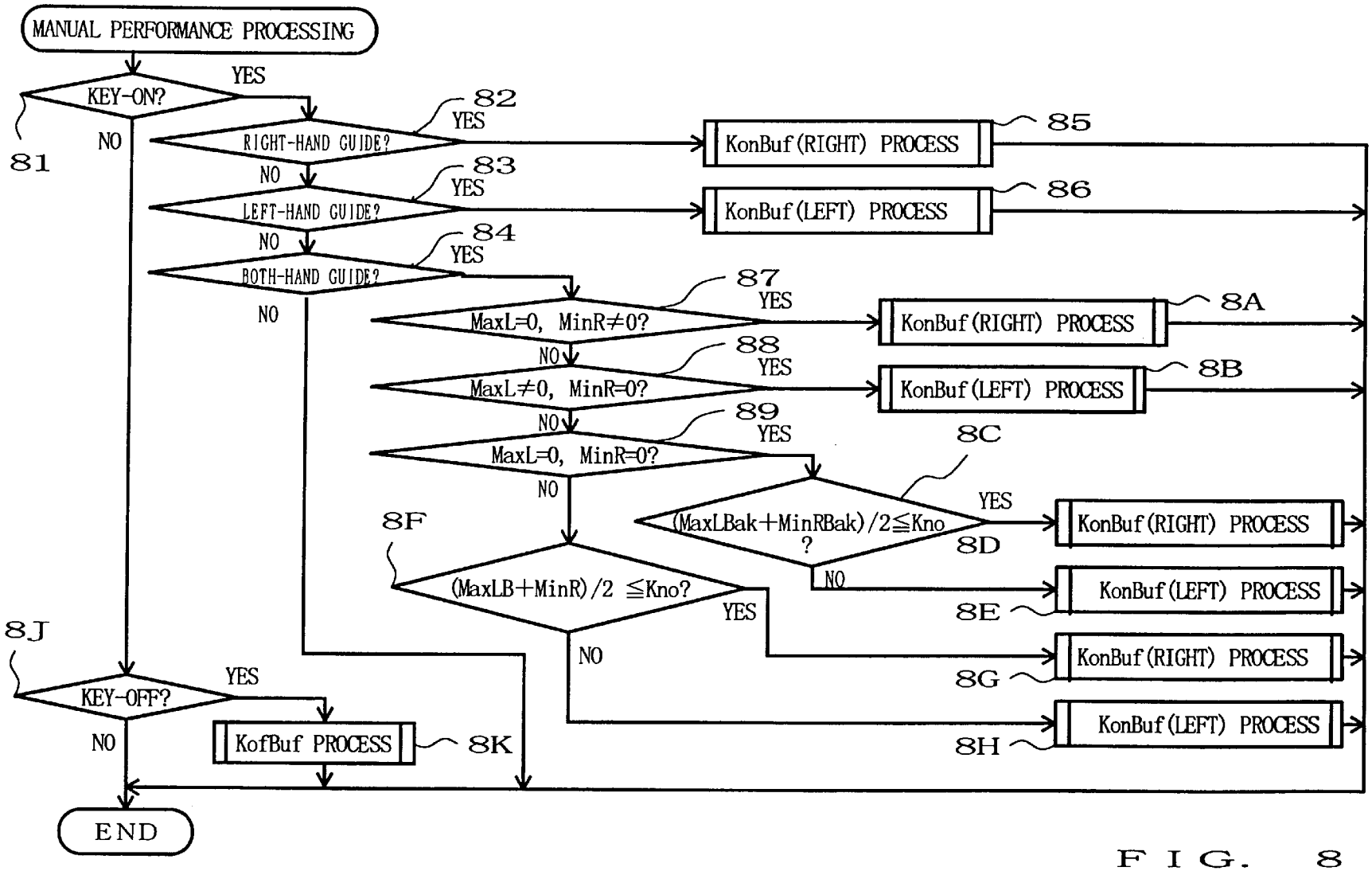
FIG. 8 is a flow chart illustrating an exemplary step sequence of manual performance processing that is carried out by the automatic performance device of the invention.

Next, a description will be made about the manual performance processing with reference to FIGS. 8 to 11. FIG. 8 is a flow chart illustrating an exemplary step sequence of the manual performance processing, which is carried out in response to generation of manual performance data by the human player or operator operating the keyboard (depressing and releasing the keys). First, at steps 81 and 8J, the manual performance data is identified. If the manual performance data is identified as key-on data, operations of steps 82 to 8H are performed, while if the manual performance data is identified as key-off data, a key-off buffer (KofBuf) process is performed at step 8K.

More specifically, the following operations take place when the manual performance data has been identified as key-on data at step 81. First, a determination is made at steps 82 to 84 as to which of the right-hand, left-hand and both-hand guide modes is currently set. If the right-hand guide mode is currently set, an affirmative (YES) determination is made at step 82, so that control goes to step 85 in order to carry out a key-on buffer process for right-hand performance (KonBuf(RIGHT)). If the left-hand guide mode is currently set, an affirmative (YES) determination is made at step 83, so that control goes to step 86 in order to carry out a key-on buffer process for left-hand performance (KonBuf(LEFT)).

Further, if the both-hand guide mode is currently set, an affirmative (YES) determination is made at step 84, so that control goes on to determining operations at steps 87 to 89. At these steps 87 to 89, subsequent operations are selected depending on the stored values in the highest-pitch note buffer MaxL and lowest-pitch note buffer MinR. Namely, if the highest-pitch note buffer MaxL currently stores "0" and the lowest-pitch note buffer MinR currently stores a value other than "0", then an affirmative (YES) determination is made at step 87, so that control goes to step 8A in order to carry out a key-on buffer process for right-hand performance (KonBuf(RIGHT)). If the highest-pitch note buffer MaxL currently stores a value other than "0" and the lowest-pitch note buffer MinR currently stores "0", then an affirmative (YES) determination is made at step 88, so that control goes to step 8B in order to carry out a key-on buffer process for left-hand performance (KonBuf(LEFT)). If both the highest-pitch note buffer MaxL and the lowest-pitch note buffer MinR currently currently store "0", then an affirmative (YES) determination is made at step 89, so that control goes to step 8C.

At step 8C, a determination is made as to whether the note number of the manual performance data (i.e., key-on data) is equivalent to or greater than a last key split point calculated on the basis of the stored values in the left-hand backup buffer MaxLBak and right-hand backup buffer MinRBak, i.e., whether or not the note number of the key-on data is to the right of the last key split point. Thus, if the note number of the key-on data is equivalent to or greater than the last key split point as determined at step 8C, control goes to step 8D in order to carry out a key-on buffer process for right-hand performance (KonBuf(RIGHT)), but if the note number of the key-on data is smaller than the last key split point, control goes to step 8E in order to carry out a key-on buffer process for left-hand performance (KonBuf(LEFT)).

Further, if both the highest-pitch note buffer MaxL and the lowest-pitch note buffer MinR currently store a value other than "0", a negative (NO) determination is made at step 89, so that control proceeds to step 8F. At step 8F, a determination is made as to whether the note number of the key-on data) is equivalent to or greater than the key split point calculated on the basis of the stored values in the highest-pitch note buffer MaxL and the lowest-pitch note buffer MinR, i.e., whether or not the note number of the key-on data is to the right of the key split point. Thus, if the note number of the key-on data is equivalent to or greater than the key split point as determined at step 8F, control goes to step 8G in order to carry out a key-on buffer process for right-hand performance (KonBuf(RIGHT)), but if the note number of the key-on data is smaller than the key split point, control goes to step 8H in order to carry out a key-on buffer process for left-hand performance (KonBuf(LEFT)).

Figure 13:
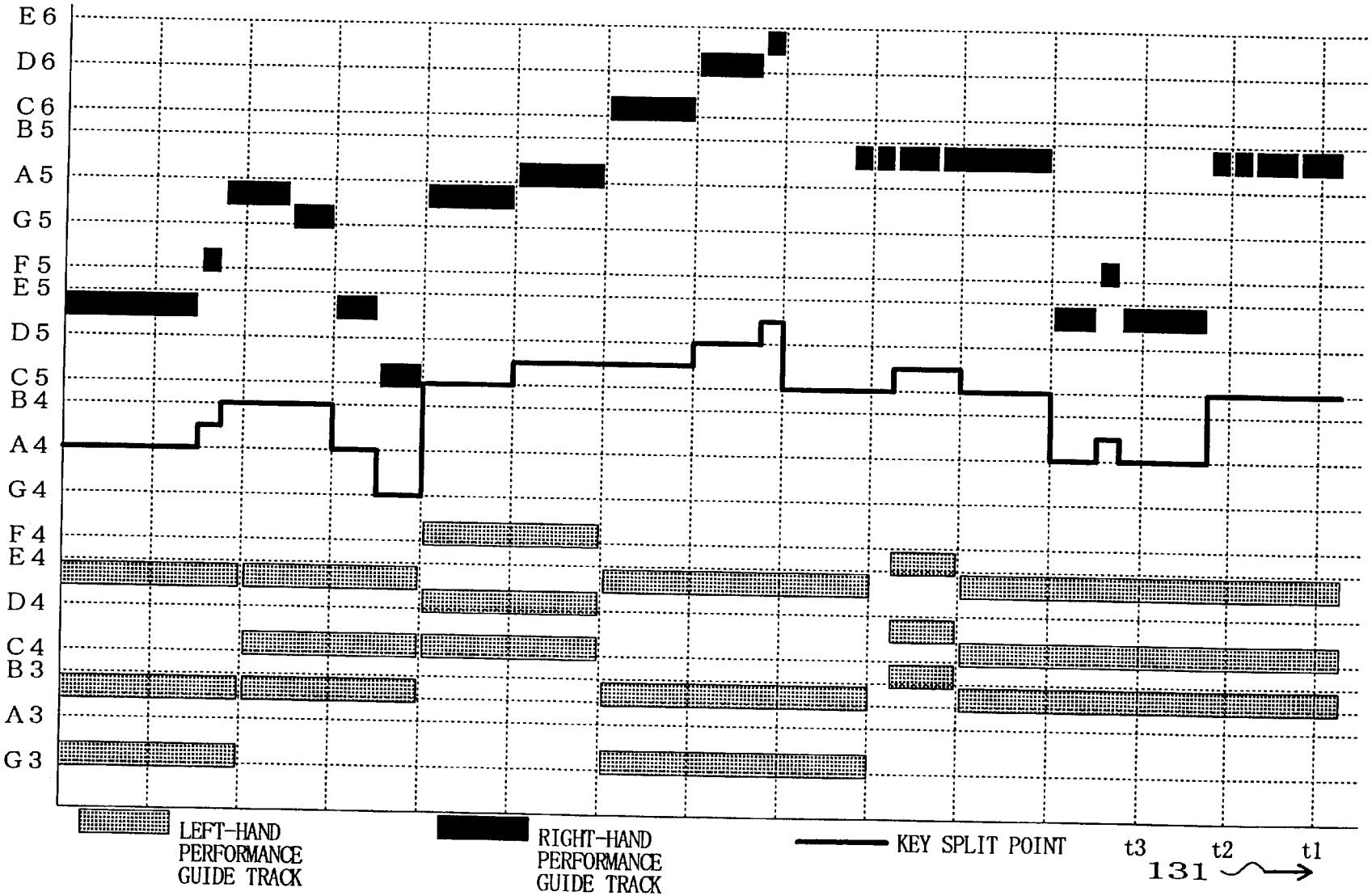
FIG. 13 is a diagram illustrating a concept of a key split point calculated in the interrupt process.

FIG. 13 is a diagram illustrating a concept of the key split point calculated in the present embodiment and showing part of a piano roll staff gradually progressing in a direction of arrow 131. In effect, the piano roll staff progresses in a right-to-left direction on the display 2G provided on the front surface of or near the keyboard; alternatively, assuming that the keyboard keys are arranged horizontally, the piano roll staff may be scrolled in a vertical direction. In FIG. 13, alphanumerics G3 to E6 represent note names corresponding to the keyboard keys, and black rectangular blocks represent a melody part corresponding to the right-hand performance guide track. Half-tone rectangular blocks represent an accompaniment part corresponding to the left-hand performance guide tracks, and heavy broken lines represents key split points varying on the basis of tone of the melody and accompaniment parts. The player is allowed to carry out a performance corresponding to the piano roll staff, by operating the keyboard while looking at such a roll staff. The automatic performance device according to the present embodiment sequentially reads out the performance data from the performance guide tracks corresponding to the roll staff and generates tones based on the read-out performance data in accordance with key-on and key-off data corresponding to player's key depression and key release.

The melody part performance is carried out on the basis of one series of performance data; thus, at time point t1, for example, note number "82" corresponding to note name "A#5" will be stored into the lowest-pitch note buffer MinR. On the other hand, the accompaniment part performance is carried out on the basis of three series of chord progression data; thus, at time point t1, for example, note number "63" corresponding to highest-pitch note name "D#4" of three note names will be stored into the highest-pitch note buffer MaxL. Therefore, a key split point can be determined by substituting, into a key-split-point calculating expression of step 8F, the stored values in the lowest-pitch note buffer MinR and highest-pitch note buffer MaxL. Namely, at time point t1, note number "72" (note name "C5") becomes a key split point. Note that a decimal fraction occurring in the calculation is ignored in the present embodiment. In this way, key split points are calculated which sequentially vary in accordance with the performance data as shown in FIG. 13.

Figure 9:
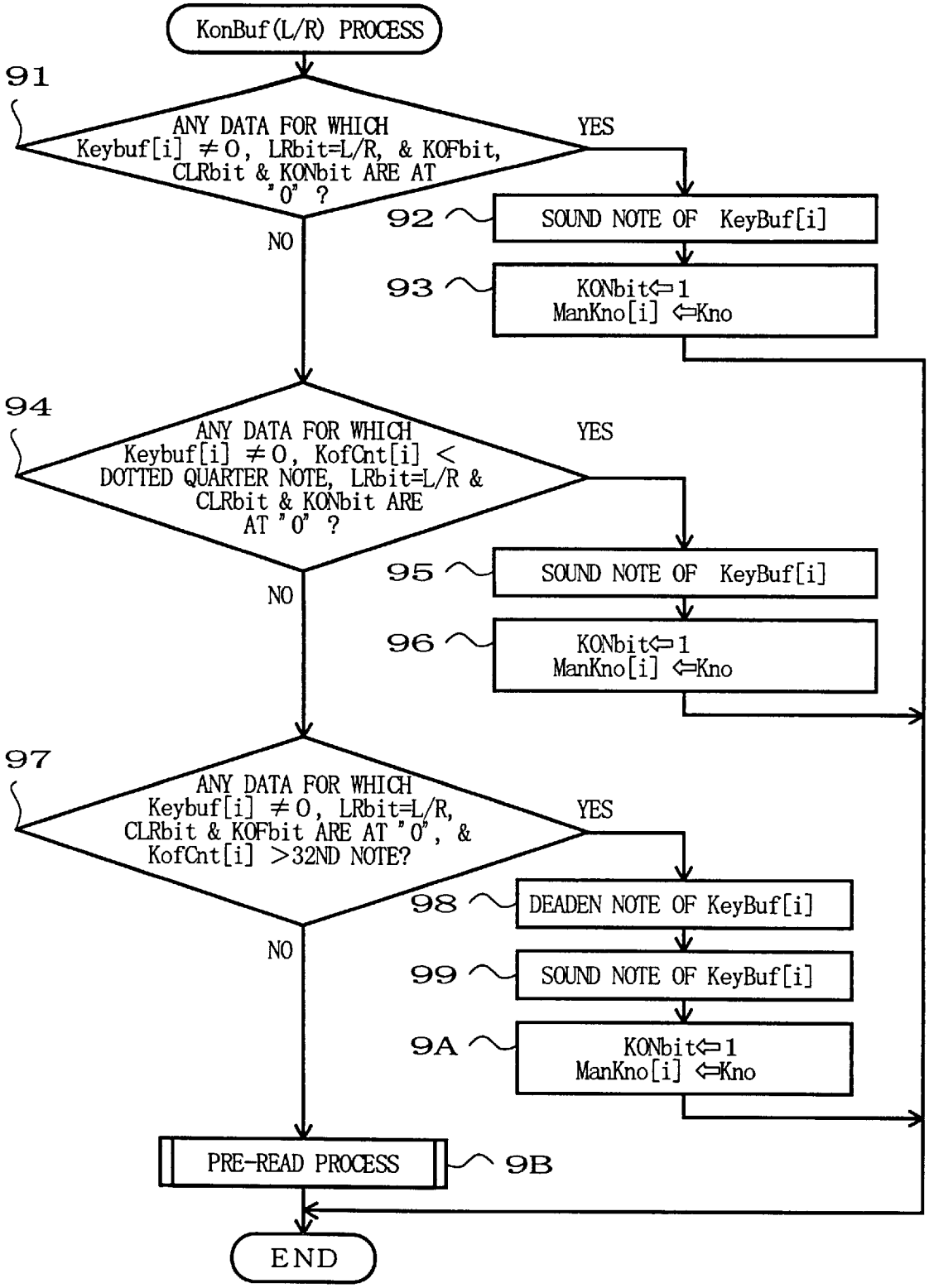
FIG. 9 is a flow chart illustrating exemplary details of a key-on buffer process in the manual performance processing of FIG. 8.

FIG. 9 is a flow chart illustrating exemplary details of the key-on buffer process for right-hand performance (KonBuf (RIGHT)) at step 85, 8A, 8D and 8G and the key-on buffer process for left-hand performance (KonBuf(LEFT)) at steps 86, 8B, 8E and 8H. The key-on buffer process for right-hand performance (KonBuf(RIGHT)) is performed, at steps 85, 8A, 8D and 8G, on one of the key buffers KeyBuf where the guide flag LRbit is at "0" since the "key depression" is for a right-hand performance part as determined at steps 82, 87, 8C and 8F, respectively. Similarly, the key-on buffer process for left-hand performance (KonBuf(RIGHT)) is performed, at steps 86, 8B, 8E and 8H, on one of the key buffers KeyBuf where the guide flag LRbit is at "1" since the "key depression" is for a left-hand part as determined at steps 82, 87, 8C and 8F, respectively. In FIG. 9, the key-on buffer process for right-hand performance and the key-on buffer process for left-hand performance are collectively designated as "KonBuf(L/R)" process, and "R" and "L" represent the key-on buffer process for right-hand performance and the key-on buffer process for left-hand performance, respectively.

First, at step 91, a determination is made as to whether there is any manual performance data for which the stored value in the key buffer KeyBuf[i] is not "0", the guide flag LRbit coincides with L/R (i.e., which of the processes L and R is indicated by the guide flag LRbit) and all of the key-off flag KOFbit, clearance wait flag CLRbit and key-on flag KONbit are at "0". If answered in the affirmative at step 91, operations of steps 92 and 93 are performed. Steps 92 generates a tone of the note number stored in the corresponding key buffer KeyBuf[i], and step 93 sets "1" into its key-on flag KONbit and stores, into the manual performance buffer ManKno[i], the note number of the manual performance, i.e., currently stored value of the key number buffer Kno corresponding to the actual key depression.

If answered in the negative at step 91, control proceeds to step 94, where it is further determined whether there is any manual performance data for which the stored value in the key buffer KeyBuf[i] is not "0", the current count of the time counter KofCnt [i] is smaller than a value corresponding to a dotted quarter note, the guide flag LRbit coincides with L/R and both the clearance wait flag CLRbit and the key-on flag KONbit are at "0". If answered in the affirmative at step 94, operations of steps 95 and 96 are performed for generating a tone of the note number stored in the corresponding key buffer KeyBuf[i] and setting "1" into its key-on flag KONbit as well as storing, into the manual performance buffer ManKno[i], the note number of the manual performance, i.e., currently stored value of the key number buffer Kno corresponding to the actual key depression.

If answered in the negative at step 94, control proceeds to step 97, where it is further determined whether there is any manual performance data for which the stored value in the key buffer KeyBuf[i] is not "0", the current count of the time counter KofCnt [i] is greater than the value corresponding to a thirty-second note (i.e., whether the time corresponding to a thirty-second note has elapsed since the beginning of sounding of the note), the guide flag LRbit coincides with L/R and both the clearance wait flag CLRbit and the key-off flag KOFbit are at "0". If there is such data as determined at step 97, then the sounding of the note is suspended at step 98, a tone of the note number stored in the corresponding key buffer KeyBuf[i] is regenerated at step 99, and "1" is set into the key-on flag KONbit and the stored value of the key number buffer Kno corresponding to the actual key depression is stored into the manual performance buffer ManKno [i] at step 9A.

In case the determinations are in the negative at all of steps 91, 92 and 97, control goes to step 98 in order to carry out a pre-read process. In the pre-read process of step 98, it is determined whether or not there is any note, in the pre-read buffer PreLdBuf[i], to be sounded within the time corresponding to an eighth note after generation of the key-on data by the player's manual performance operation. If there is such a note, the note is sounded, but if not, the manual performance processing is brought to an end.

Figure 10:
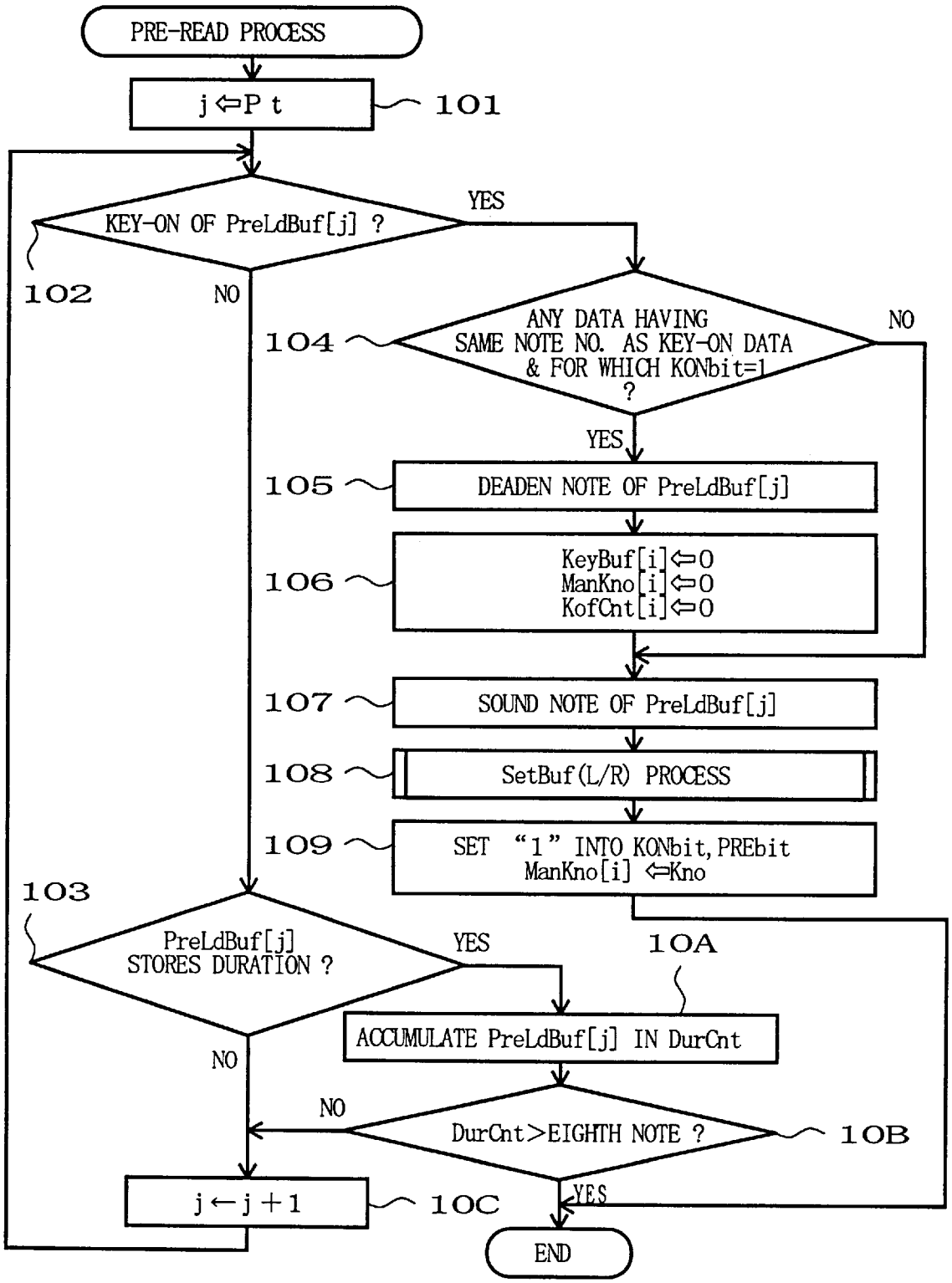
FIG. 10 is a flow chart illustrating exemplary details of a pre-read process in the key-on buffer process of FIG. 9.

FIG. 10 is a flow chart illustrating exemplary details of the pre-read process. First, at step 101, the read pointer Pt is set to variable j as a current readout location in the pre-read buffer PreLdBuf[j]. Then, at steps 102 and 103, it is determined whether the data currently stored in the pre-read buffer PreLdBuf[j] is key-on data or duration data. If the stored data is key-on data as determined at step 102, control goes to step 104, but if the stored data is duration data as determined at step 103, control goes to step 10A. In case the currently stored data in the pre-read buffer PreLdBuf[j] is neither key-on data nor duration data, control goes to step 10C, where the variable j is incremented by one to advance the read pointer Pt.

At step 104, a further determination is made as to whether or not the key buffer KeyBuf[i] contains any data which has the same note number of the key-on data and for which the key-on flag KONbit is currently at "1". Namely, at step 104, it is determined whether or not the currently generated tone is the same as the key-on data contained in the pre-read buffer within the time corresponding to an eighth note after occurrence of the key-on event by player's manual performance operation. Thus, if answered in the affirmative at step 104, the tone of the note number read out from the pre-read buffer PreLdBuf[j] is muted or deadened at step 105 and the key buffer KeyBuf[i], manual performance buffer ManKno [i] and time counter KofCnt[i] are set to "0", in order to regenerate the same tone.

Then, a tone corresponding to the note number stored in the pre-read buffer PreLdBuf[j] is generated at step 107, and a buffer setting process (SetBuf (L/R)) is carried out at step 108 to register, into various buffers, information about the tone generated on the basis of the pre-read buffer PreLdBuf [j]. This buffer setting process (SetBuf (L/R)) is the same as that of FIG. 6 and will not be described in detail to avoid unnecessary duplication. At next step 109, "1" is set into the key-on flag KONbit and ahead-of-timing sounding flag PREbit, and the note number of the manual performance data is set into the manual performance buffer ManKno[i].

If, on the other hand, the data read out from the preread buffer PreLdBuf[j] is duration data as determined at step 103, the duration counter DurCnt accumulates the duration data value at step 10A. Then, at step 10B, a determination is made as to whether or not the counted value of the duration counter DurCnt is greater than the time corresponding to an eighth note. If the determination is in the affirmative at step 10B, the key-on buffer process of FIG. 9 is brought to an end; otherwise, control goes to step 10C to increment the variable j by one and then loops back to step 102 to read out the next data from the pre-read buffer PreLdBuf[j] in order to repeat similar operations.

Figure 11:
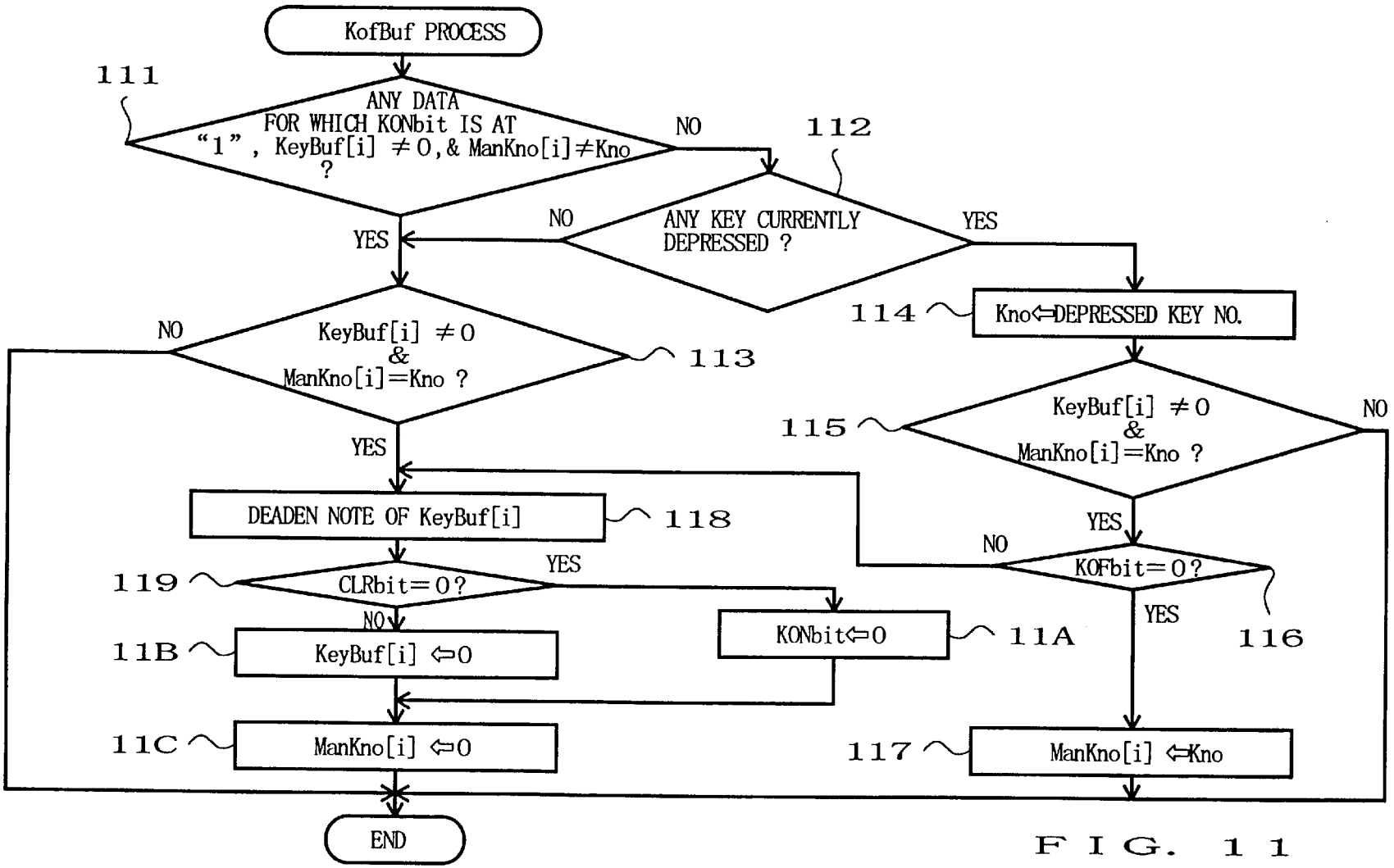
FIG. 11 is a flow chart illustrating exemplary details of a key-off buffer process in the manual performance processing of FIG. 8.

In the case where the manual performance data has been identified as key-off data at step 8J of FIG. 8, the key-off buffer process (KofBuf) is carried out at step 8K. FIG. 11 is a flow chart illustrating exemplary details of the key-off buffer process.

First, at step 111, it is determined whether or not there is any data for which the key-on flag KONbit of the key buffer KeyBuf[i] is at "1" and the note number stored in the manual performance buffer ManKno[i] is different from that of the manual performance data (key-off data). Namely, at this step, it is ascertained whether any note number is being currently sounded in response to depression of another key than the newly-released key. If answered in the affirmative at step 111, control proceeds to step 113; otherwise, control goes to step 112.

At step 112, it is ascertained whether any key other than the newly-released key is still being depressed. If, for example, the keys of note names "D3" and "B3" have been depressed one after another at a short interval (e.g., with a time difference corresponding to the time length of a thirty-second note) as shown in FIG. 15B, the present embodiment sounds note name "C3" as a tone of the pitch corresponding to the first depressed key of note name "D3", but generates no tone at such a time point corresponding to the second depressed key of note name "B3". In case the key of note name "D3" is released in a relatively short time as shown in FIG. 15B, the tone of note name "C3" would be undesirably deadened at the time of the key release although the tone of note name "C3" is still being generated. Thus, the present embodiment makes the determination of step 12 in order to continue generation of the tone corresponding to the first depressed key of note name "D3" even after the "D3" key has been released, depending on a depressed state of the "B3" key.

Although not specifically shown, the operations of steps 111 and 112 are looped for all of the key buffers KeyBuf [0]–[15] and the process gets out of the looping when an affirmative (YES) determination results somewhere.

Therefore, the affirmative (YES) determination at step 112 indicates that there is a currently-depressed key which does not actually contribute to tone generation as in the case of FIG. 15B. At step 114, the unique key number of the currently-depressed key is stored into the key number buffer Kno. At next step 115, it is determined whether any note number is currently stored in the key buffer KeyBuf[i] and the note number stored in the manual performance buffer ManKno[i] matches that of the manual performance data (key-off data). If a negative (NO) determination is made at step 115, the manual performance processing is brought to an end; otherwise, control moves on to step 116 in order to further determine whether the key-off flag KOFbit is at "0". If the key-off flag KOFbit is at "0", it means that a tone corresponding to the depressed key is being generated, so that control goes to step 117 in order to store, into the manual performance buffer ManKno[i], the key number stored in the key number buffer Kno, i.e., the key number of the depressed key not having actually contributed to tone generation. If, on the other hand, the key-off flag KOFbit is at "1", it means that the tone of the corresponding key number has already been turned off in the performance data reproduction processing, so that control proceeds to step 118.

With an affirmative determination at step 111 or with a negative determination at step 112, control goes to step 113 to make a determination similar to that of step 115. The affirmative determination at step 111 means that a note number is being currently sounded in response to player's depression of a key other than the newly-released key, and the negative determination at step 112 means that no key is being currently depressed. Thus, a determination is made at step 113 as to whether the manual performance buffer ManKno[i] contains a note number corresponding to that of the manual performance data (key-off data). If answered in the affirmative at step 113, control proceeds to step 118 in order to mute or deaden the tone corresponding to the note number currently stored in the key buffer KeyBuf[i]. After that, it is further determined at step 119 whether the clearance wait flag CLRbit is at "0". If the clearance wait flag CLRbit is at "0" as determined at step 119, control goes to step 11A in order to set "0" into the key-on flag KONbit and then proceeds to step 1C. If the clearance wait flag CLRbit is at "1", control goes to step 11B in order to set "0" into the key buffer KeyBuf[i] and then proceeds to step 1C. At step 1C, "0" is set into the manual performance buffer ManKno [i].

The following paragraphs describe the timer interrupt process of FIG. 12, which is carried out at a frequency of 96 times per quarter note (the frequency is variable depending on a selected performance tempo). Let's also assume that the resolution of the duration data is 96 per quarter note.

First, at step 121, the time having so far elapsed, whose minimum unit value is "1", is added to the counts of the time counters RSplKofCnt and LSplKofCnt. Where the interrupt timing is fixed rather than being varied depending on a selected performance tempo, then a value corresponding to the tempo may be added to the counts of the time counters. Because these time counters RSplKofCnt and LSplKofCnt count a time having passed from a point when the key-on counters RKonCnt and LKonCnt were set to "0", a determination is made at next step 122 as to whether or not the stored value in the time counter for right-hand performance RSplKofCnt is greater than the time length value corresponding to a dotted quarter note and the key-off flag KOFbit of the lowest-pitch note buffer MinR is at "1", i.e., whether or not the time corresponding to a dotted quarter note has elapsed since all of the keys corresponding to the right-hand performance guide track were placed in the key-off state. If an affirmative determination is made at step 122, control goes to step 123, where the data of the lowest-pitch note buffer MinR is stored into the right-hand backup buffer MinRBak and "0" is set into the lowest-pitch note buffer MinR. At following steps 124 and 125, operations similar to those of steps 122 and 123 are performed on the time counter for left-hand performance LSplKofCnt, left-hand backup buffer MaxLBak and highest-pitch note buffer MaxL.

Operations of steps 126 to 12A are looped for all the values "0" to "15" of the variable "i". At step 126, a determination is made as to whether either the key-on flag KONbit or the key-off flag KOFbit of the key buffer KeyBuf [i] is at "1". With an affirmative answer, control goes to step 127. With a negative answer, the variable "i" is incremented by one and the same determination is repeated for the next key buffer KeyBuf[i]; such increment of the variable "i" and determination are repeated until the variable "i" reaches the value "15".

At step 127, the time having elapsed is added to the count of the time counter KofCnt. Here, the minimum unit value of the time is also "1". At next step 128, a determination is made as to whether or not the stored value in the time counter KofCnt is greater than the value corresponding to a quarter note. If so, a further determination is made at step 129 as to whether the key-on flag KONbit is currently at "0". If an affirmative determination is made at both steps 128 and 129, it means that no tone is being generated, so that control goes to step 12A in order to set "0" into the key buffer KeyBuf[i], manual performance buffer ManKno and time counter KofCnt[i].

Essential behavior of the automatic performance device based on the above-described operations may be outlined as follows.

(1) Once the player depresses any one of the keyboard keys, generation of a tone is initiated on the basis of a note read out from the right-hand or left-hand performance guide track. The tone continues to be generated until the key is released and is deadened upon release of the key. In the case of a decaying tone color such as that of a piano, the tone may be deadened before the key release.

(2) Even when the player depresses keys somewhat ahead of or behind predetermined key-on and key-off timing of notes recorded in the performance guide track, tones can be generated with considerably accurate musical intervals.

(3) Each chord recorded in the performance guide track (a plurality of notes to be sounded substantially simultaneously) can be sounded by depression of just a single key. The chord can also be sounded by depression of a plurality of keys as in a normal performance.

(4) When a plurality of keys are depressed together on the keyboard, only one tone generation takes place as long as the intervals or time differences between the key depressions are within the time length corresponding to a thirty-second note.

(5) In the both-hand guide mode, human player's depression of any one of the keys that roughly appears to correspond to a note in the right-hand performance guide track can cause a tone to be generated on the basis of a note read out from the right-hand performance guide track. Similarly, depression of any one of the keys that roughly appears to correspond to a note in the left-hand performance guide track can cause a tone to be generated on the basis of a note read out from the left-hand performance guide track. Namely, by the player just depressing any one of the keys that roughly appears to correspond to a note to be sounded, tone generation for the right-hand performance guide track and left-hand performance guide track can be controlled, independently of each other, without a need to depress the keys exactly as instructed through the performance guide.

Now, a description will be made about detailed behavior of the automatic performance device.

Figure 1A:
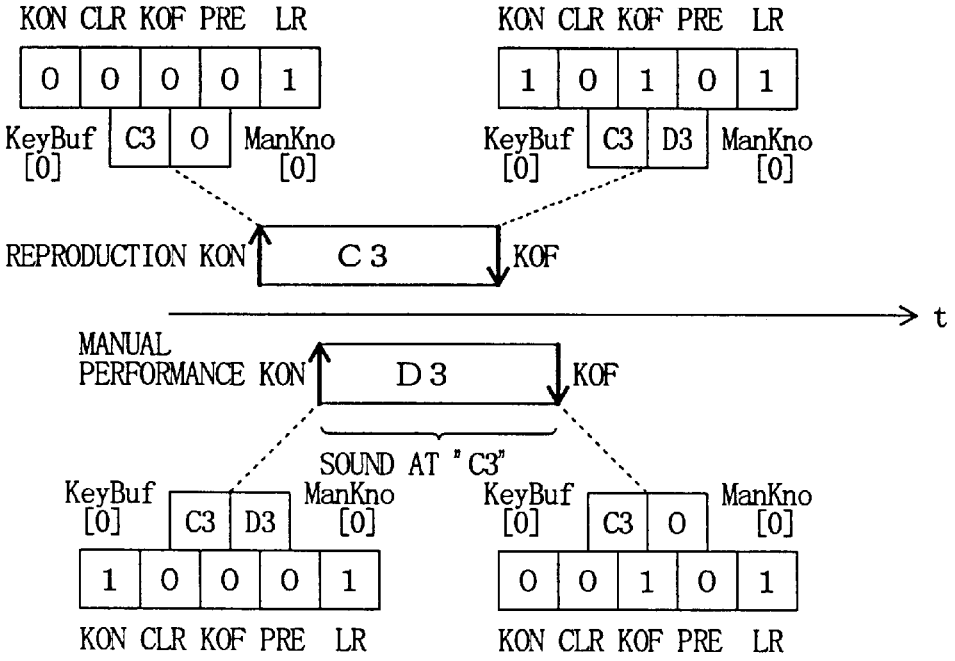
FIGS. 1A and 1B are diagrams explanatory of a first example of a manner in which an automatic performance device of the present invention operates in response to human player's performance operation.
Figure 1B:
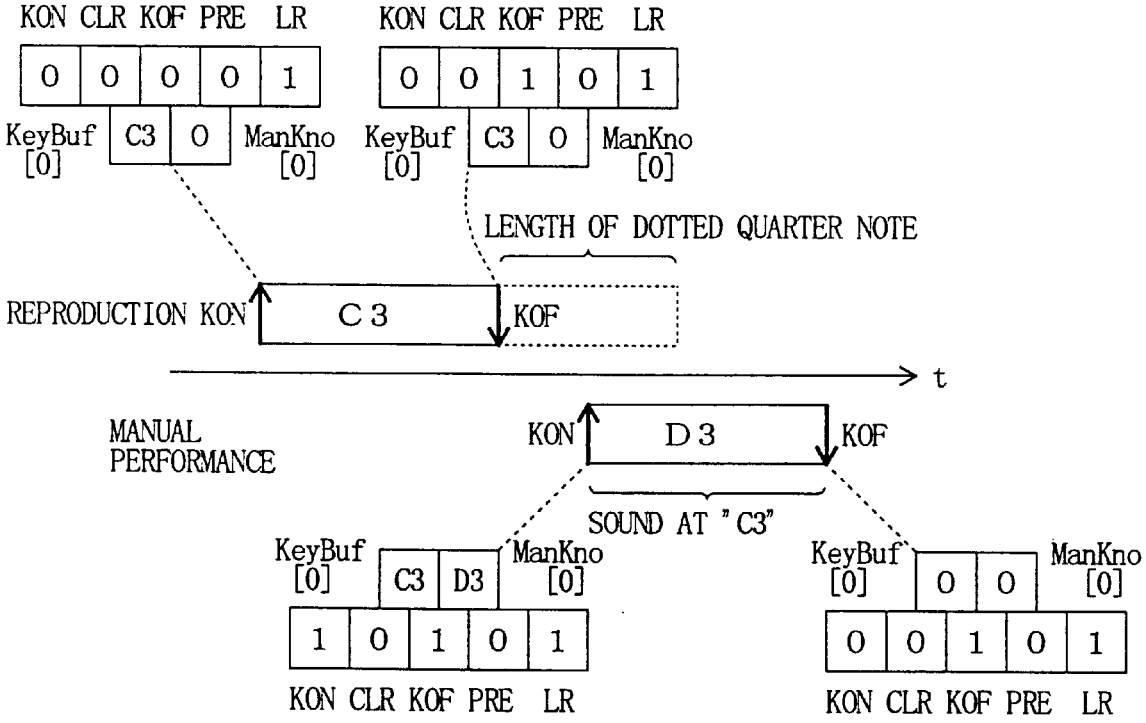

FIGS. 1A and 1B are diagrams explanatory of the operation of the automatic performance device when the data are reproduced from the left-hand performance guide track and performance operation corresponding to the reproduced data is executed by the human player or operator.

First, with reference to FIG. 1A, a description will be made about the operation of the automatic performance device when the key of note name "D3" is depressed between reproduced key-on and key-off events KON and KOF of note name "C3" and then the key of note name "D3" is released after the key-off event KOF of note name "C3". In this case, key number "48" corresponding to note name "C3" is set into the key buffer KeyBuf[0], at which time the settings of the key-on flag KONbit, clearance wait flag CLRbit, key-off flag KOFbit, ahead-of-timing sounding flag PREbit and guide flag LRbit are "00001" as shown on the upper left of FIG. 1A.

Then, once the key of note name "D3" is manually depressed and key-on event KON occurs, an affirmative determination is made at step 91 of FIG. 9, so that a tone of note name "C3" currently set in the key buffer KeyBuf[0] is generated at step 92 and "1" is set into the key-on flag KONbit and key number "50" corresponding to the manually performed note name "D3" is set into the manual performance buffer ManKno[0] at step 93. As a result, the settings of the above-mentioned flags KONbit, CLRbit, KOFbit, PREbit and LRbit change to "10001" as shown on the lower left of FIG. 1A.

Then, in response to reproduction of key-off event KOF of note name "C3", the settings of the above-mentioned flags KONbit, CLRbit, KOFbit, PREbit and LRbit change to "10101" as shown on the upper right of FIG. 1A.

Then, once the manually-operated key of note name "D3" is released and corresponding key-off event KOF occurs, the key-off buffer process of FIG. 11, at step 118, deadens the tone of note name "C3" set in the key buffer KeyBuf[0] by way of steps 111, 112 and 113.

Next, with reference to FIG. 1B, a description will be made about the operation of the automatic performance device when the key of note name "D3" is depressed within the time length of a dotted quarter note after occurrence of key-off event KOF of note name "C3". In this case, in response to reproduction of key-on event KON of note name "C3", the settings of the key-on flag KONbit, clearance wait flag CLRbit, key-off flag KOFbit, ahead-of-timing sounding flag PREbit and guide flag LRbit change to "00001" as shown on the upper left of FIG. 1B, similarly to the example of FIG. 1A. Then, in response to reproduction of the key-off event KOF of note name "C3", the settings of the the above-mentioned flags KONbit, CLRbit, KOFbit, PREbit and LRbit change to "00101" as shown on the upper right of FIG. 1A.

Then, key-on event KON by manual depression of the key of note name "D3" occurs within the time length of a dotted quarter note after the reproduction of the key-off event KOF of note name "C3". Due to the key-on event KON, a negative determination is made at step 91 of FIG. 9 and an affirmative determination is made at step 94. Thus, a tone of note name "C3" set in the key buffer KeyBuf[0] is generated at step 95, and "1" is set into the key-on flag KONbit and key number "50" corresponding to the manually performed note name "D3" is set into the manual performance buffer ManKno[0] at step 96. As a result, the settings of the above-mentioned flags KONbit, CLRbit, KOFbit, PREbit and LRbit change to "10101" as shown on the lower left of FIG. 1B.

Figure 14:
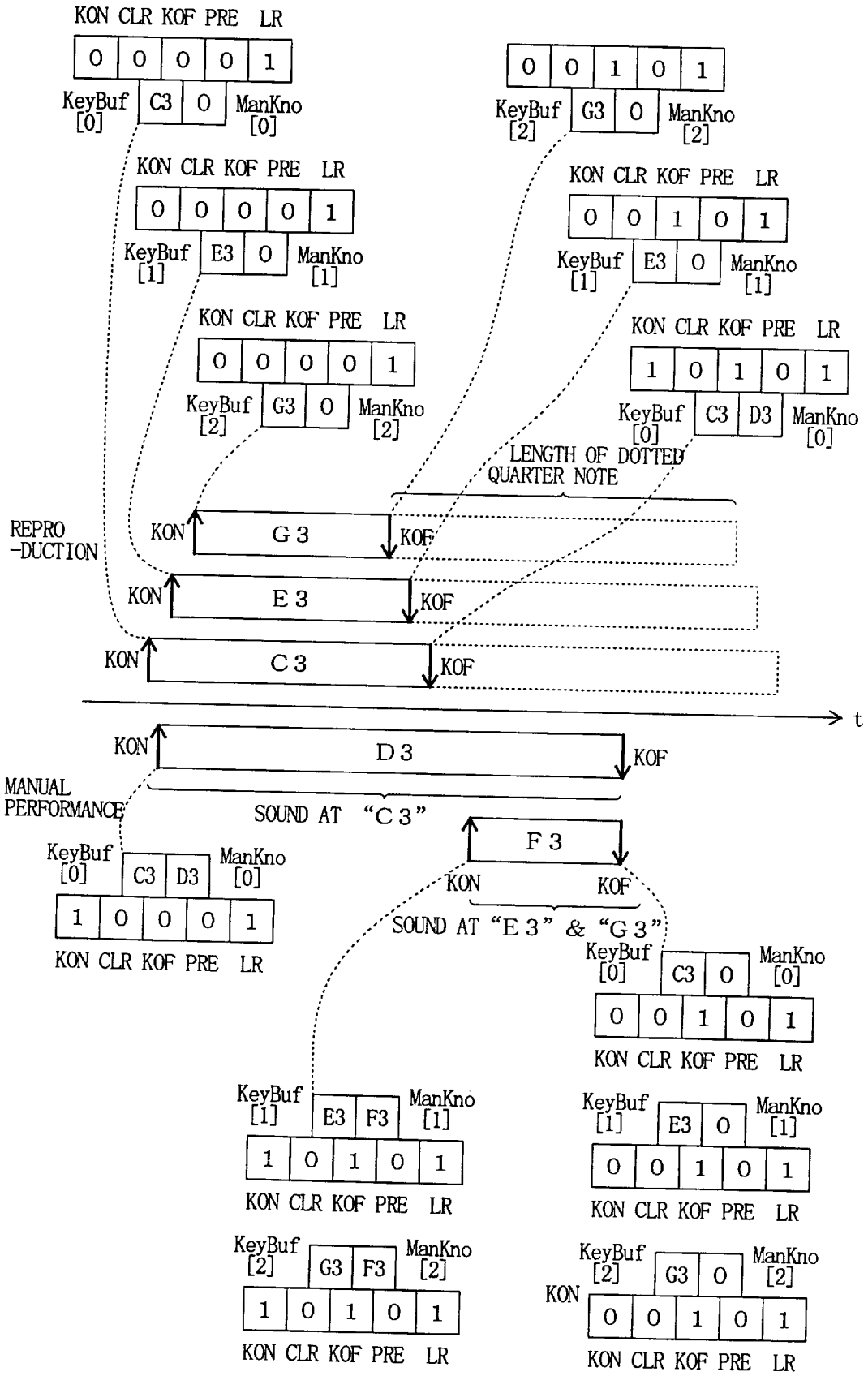
FIG. 14 is a diagram explanatory of a second example of the manner in which the automatic performance device of the present invention operates in response to human player's performance operation.

Then, once the manually-operated key of note name "D3" is released and key-off event KOF occurs, the key-off buffer process of FIG. 11, at step 118, deadens the tone of note name "C3" set in the key buffer KeyBuf[0] by way of steps 111, 112 and 113. Thus, the settings of the the above-mentioned flags KONbit, CLRbit, KOFbit, PREbit and LRbit change to "00101" as shown Next, with reference to FIG. 14, a description will be made about the operation of the automatic performance device when in response to key-on event KON for a chord performance of note names "C3", "E3" and "G3", the keys of note names "D3" and "F3" are depressed at an interval, or with a time difference, as shown. Particularly, a special case will be described here where the key of note name "D3" is depressed between reproduced key-on events KON of note names "C3" and "E3". In this case, key number "48" corresponding to note name "C3" is first set into the key buffer KeyBuf[0] in response to reproduction of the key-on event KON of note name "C3", so that the settings of the key-on flag KONbit, clearance wait flag CLRbit, key-off flag KOFbit, ahead-of-timing sounding flag PREbit and guide f lag LRbit change to "00001" as shown on the upper left of FIG. 14. Thus, by this time, one key-on event has occurred from the left-hand performance guide track.

Then, once the key of note name "D3" is manually depressed and key-on event KON occurs, an affirmative determination is made at step 91 of FIG. 9, so that a tone of note name "C3" currently set in the key buffer KeyBuf[0] is generated at step 92 and "1" is set into the key-on flag KONbit and key number "50" corresponding to the manually performed note name "D3" is set into the manual performance buffer ManKno[0] at step 93. As a result, the settings of the above-mentioned flags KONbit, CLRbit, KOFbit, PREbit and LRbit change to "10001".

Immediately after that, key-on events KON of note names "E3" and "G3" are reproduced, one after another, within the time length of a dotted thirty-second note after occurrence of the key-on event KON of note name "C3". Key number "52" corresponding to note name "E3" is set into the key buffer KeyBuf[1] in response to reproduction of the key-on event KON of note name "E3". Thus, by this time, two key-on events have occurred from the left-hand performance guide track.

Then, key number "55" corresponding to note name "G3" is set into the key buffer KeyBuf[2] in response to reproduction of the key-on event KON of note name "G3". As a result, the settings of the above-mentioned flags KONbit, CLRbit, KOFbit, PREbit and LRbit of the the key buffer KeyBuf[2] change to "00001". Thus, by this time, three key-on events have occurred from the left-hand performance guide track.

After that, in response to reproduction of key-off event KOF of note name "G3", the settings of the above-mentioned flags KONbit, CLRbit, KOFbit, PREbit and LRbit of the the key buffer KeyBuf[2] change to "00101". Similarly, in response to reproduction of key-off events KOF of note names "E3" and "C3", the settings of the above-mentioned flags KONbit, CLRbit, KOFbit, PREbit and LRbit of the key buffers KeyBuf[1] and KeyBuf[0] change to "00101".

Then, once key-on event KON occurs by manual depression of the key of note name "F3" after the reproduction of the key-off event KOF of note name "c3", a negative determination is made at step 91 of FIG. 9 and an affirmative determination is made at step 94 for the key buffers KeyBuf [1] and KeyBuf[2]. Thus, a tone of note name "E3" currently set in the key buffer KeyBuf[1] is generated and a tone of note name "G3" currently set in the key buffer KeyBuf[2] is generated at step 95. As a result, the settings of the above-mentioned flags KONbit, CLRbit, KOFbit, PREbit and LRbit of the key buffers KeyBuf[1] and KeyBuf[2] change to "10101".

After that, once the manually-operated key of note name "D3" is released and key-off event KOF occurs, the currently-depressed key number "53", i.e., note name "F3", is stored into the key number buffer Kno at step 114 by way of steps 111 and 112 of FIG. 11. Then, an affirmative determination is made at step 115 and a negative determination is made at step 116, so that the operation of step 118 is carried out to deaden the tone of note name "C3" stored in the key buffer KeyBuf[0].

Then, once the manually-operated key of note name "F3" is released and key-off event KOF occurs, an affirmative determination is made at step 113, and the tone of note name "E3" stored in the key buffer KeyBuf[1] is deadened at step 118. Similar operations take place for the key buffer KeyBuf [2], so that the tone of note name "G3" is deadened.

Next, with reference to FIG. 15A, a description will be made about the operation of the automatic performance device when the two keys of note names "D3" and "B3" are depressed, at an interval, or with a time difference, greater than the time length of a thirty-second note between key-on event KON and key-off event KOF of note name "C3". In this case, key number "48" corresponding to note name "C3" is set into the key buffer KeyBuf E[0] in response to reproduction of the key-on event KON of note name "C3", so that the settings of the key-on flag KONbit, clearance wait flag CLRbit, key-off flag KOFbit, ahead-of-timing sounding flag PREbit and guide flag LRbit change to "00001" as shown.

Then, once key-on event KON occurs by manual depression of the key of note name "D3", a tone of note name "C3" currently set in the key buffer KeyBuf[0] is generated in a similar manner to FIG. 1A. As a result, the settings of the above-mentioned flags KONbit, CLRbit, KOFbit, PREbit and LRbit change to "10001". After the occurrence of the key-on event of note name "D3", the key of note name "B3" is depressed with a time difference greater than the time length of a thirty-second note. Because the count of the time counter KonCnt[0] is now greater than the the time length of a thirty-second note, an affirmative determination is made at step 97 by way of steps 91 and 94 in FIG. 9, so that the tone of note name "C3" currently set in the key buffer KeyBuf[]0 is deadened at step 98. At next step 99, the tone of note name "C3" currently set in the key buffer KeyBuf[]0 is regenerated.

Then, once the manually-operated key of note name "D3" is released and key-off event KOF occurs, a negative determination is made at step 113 although an affirmative determination is made at step 111 of FIG. 11, and thus the process comes to an end without doing anything further.

After that, in response to reproduction of key-off event KOF of note name "C3", the settings of the above-mentioned flags KONbit, CLRbit, KOFbit, PREbit and LRbit change to Then, once the manually-operated key of note name "B3" is released and key-off event KOF occurs, an affirmative determination is made at step 113 by way of steps 111 and 112, and the tone of note name "C3" stored in the key buffer KeyBuf[0] is deadened at step 118.

Next, with reference to FIG. 15B, a description will be made about the operation of the automatic performance device when the two keys of note names "D3" and "B3" are depressed in succession, within the time length of a thirty-second note, between key-on event KON and key-off event KOF of note name "C3". In this case, operations responsive to reproduction of the key-on event of note name "C3" and manual depression of the key of note name "D3" are the same as those in the example of FIG. 15A and will not be described in detail to avoid unnecessary duplication.

The key of note name "B3" is depressed within the time length of a thirty-second note after occurrence of the key-on event of note name "D3". Because the count of the time counter KonCnt[0] is now smaller than the time length of a thirty-second note, the pre-read process of step 9B (FIG. 10) is carried out by way of steps 91, 94 and 97 of FIG. 9. In the example of FIG. 15B, no note to be sounded is present in the pre-read buffer PreLdBuf[i] within the time length of an eighth note from the current point, the manual performance processing of FIG. 8 is terminated without generating a tone corresponding to the depressed key of note name "B3".

Then, once the manually-operated key of note name "D3" is released and key-off event KOF occurs, an affirmative determination is made at step 111. Because another key than the released key is being depressed, an affirmative determination is made at step 112. At step 114, key number "59" corresponding to note name "B3" is stored into the key number buffer Kno as a currently depressed key number. Because the stored value in the manual performance buffer ManKno[0] matches the released key number, an affirmative determination is made at step 115. Also, an affirmative determination is made at step 116 now that the key-off flag KOFbit is at "0". Then at step 117, the currently-depressed key number, i.e., key number "59" corresponding to note name "B3", is stored into the manual performance buffer ManKno[0]. Namely, at this time, only the stored value in the manual performance buffer ManKno[0] varies, and the last tone continues to be generated.

Figure 15A:
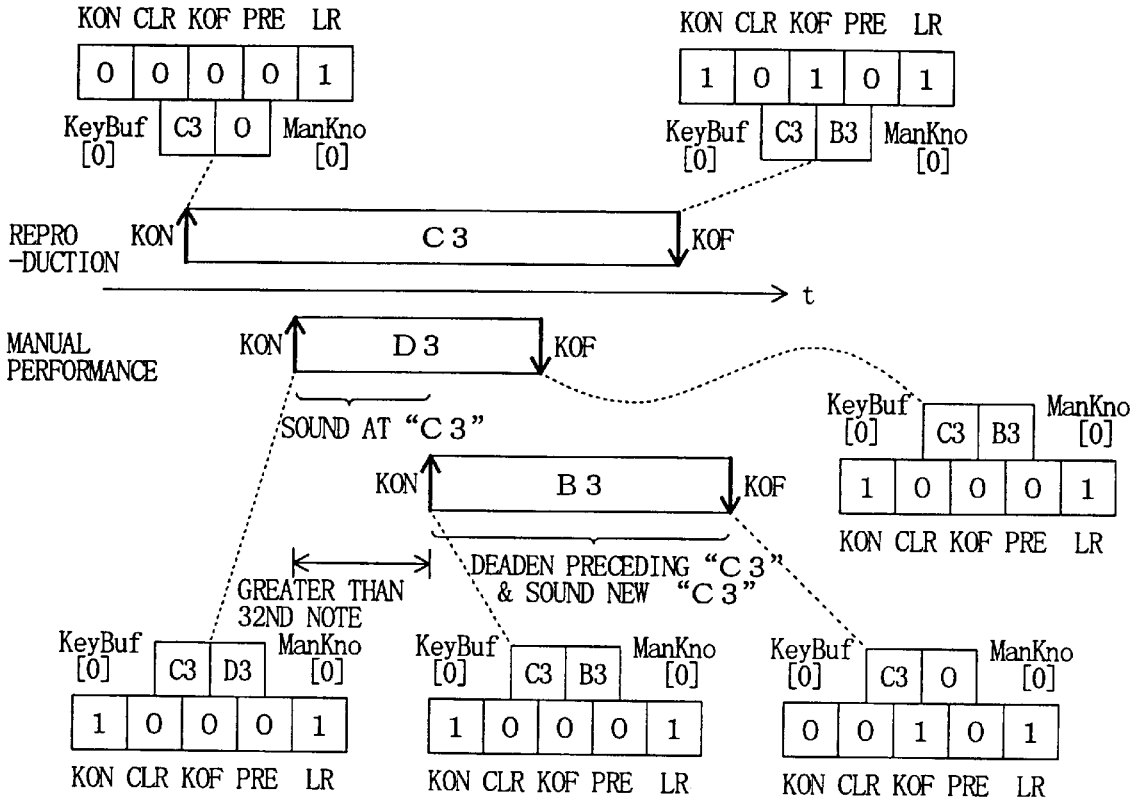
FIGS. 15A and 15B are diagrams explanatory of a third example of the manner in which the automatic performance device of the present invention operates in response to human player's performance operation.
Figure 15B:
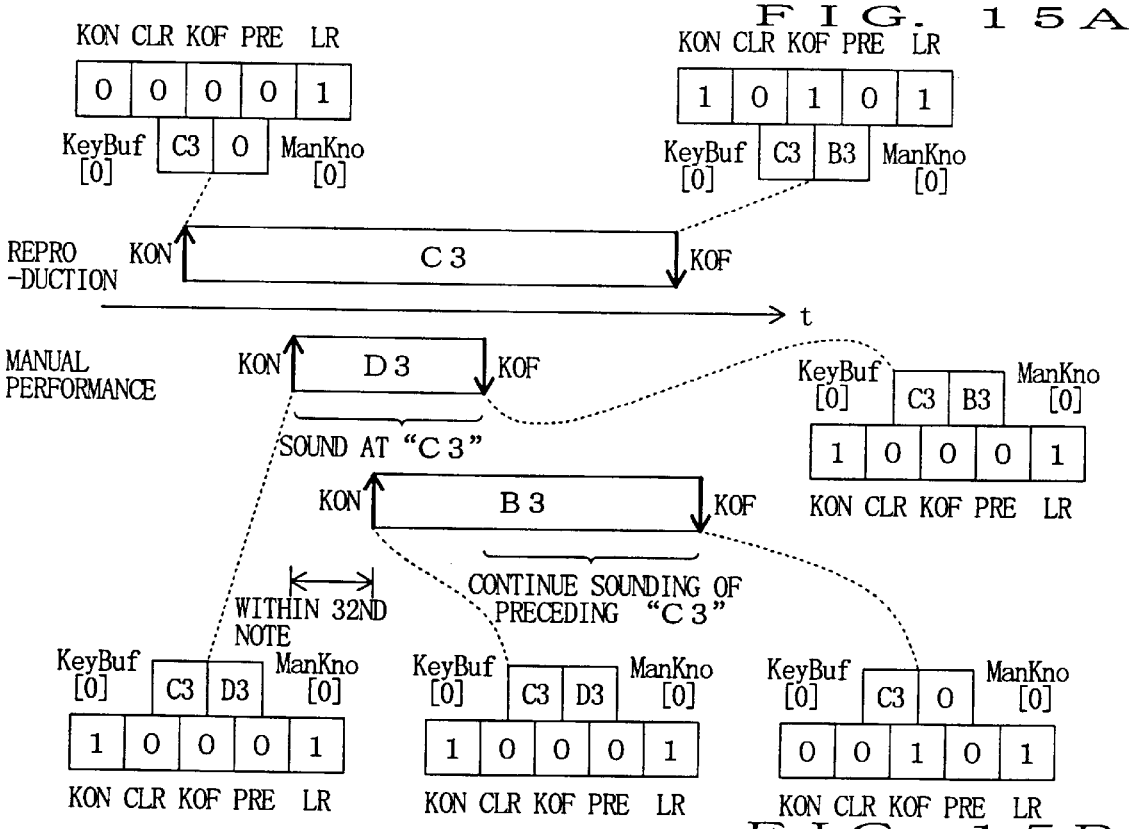

Operations responsive to reproduction of the key-off event of note name "C3" and manual release of the key of note name "B3" are the same as those in the example of FIG. 15A.

In the event that the keys are depressed in succession at an interval, or with a time difference, greater than the length of a thirty-second note as shown in FIG. 15A, the currently generated tone is temporarily deadened and regenerated at a time point corresponding to next key depression. In contrast, if the time interval between the two depressed keys is not greater than the time length of a thirty-second note as shown in FIG. 15B, the current tone generating state is maintained rather than being varied.

Next, with reference to FIG. 16A, a description will be made about the operation of the automatic performance device when the key of note name "D3" is depressed after lapse of the time corresponding to a dotted quarter note following reproduction of key-off event KOF of note name "E3" and yet within the time length corresponding to an eighth note preceding reproduction of key-on event of note name "C3".

In this case, in response to reproduction of key-on event KON of note name "C3", the settings of the above-mentioned flags KONbit, CLRbit, KOFbit, PREbit and LRbit change to "00001", and key number "52" corresponding to note name "E3" is stored into the key buffer KeyBuf [0]. Then, in response to reproduction of the key-off event KOF of note name "E3", "1" is set into the key-off flag KOFbit at step 72, and the settings of the above-mentioned flags KONbit, CLRbit, KOFbit, PREbit and LRbit change to "00101".

Following reproduction of the key-off event KOF of note name "E3", the time corresponding to a dotted quarter note passes. Upon lapse of the time corresponding to a dotted quarter note, an affirmative determination is determined at steps 128 and 129, and "0" is set at step 12A into the key buffer KeyBuf [0], manual performance buffer ManKno [0] and time counter KofCnt[0].

Then, key-on event KON occurs by manual depression of the key of note name "D3", in response to which a negative determination is made at step 91, 94 and 97 of FIG. 9 so that the pre-read process of step 9B (FIG. 10) is carried out. Because duration data is currently stored in the pre-read buffer PreLdBuf[j], a negative determination is made at step 102 and an affirmative determination is made at step 103, so that the value of the duration data is accumulated in the duration counter DurCnt at step 10A. After that, a determination is made as to whether the stored value in the duration counter DurCnt is greater than the time length corresponding to an eighth note. Because the stored value in the duration counter DurCnt in this case is smaller than the time length corresponding to an eighth note, control goes to step 10C to increment the variable j by one and then loops back to step 102. Because key-on data of note name "C3" is currently stored in the pre-read buffer PreLdBuf[j+1], an affirmative determination is made at step 102. Because there is presently no key buffer KeyBuf whose key-on flag is at "1", a negative determination is made at step 104, so that a tone of note name "C3" currently set in the pre-read buffer PreLdBuf[j+1] is generated at step 107. After that, the buffer setting process of FIG. 6 is carried out at step 108, where key number "48" corresponding to note name "C3" is set into the key buffer KeyBuf[0] at step 68. Thus, the settings of the above-mentioned flags KONbit, CLRbit, KOFbit, PREbit and LRbit of the key buffer KeyBuf[0] change to "00001". Then, at step 109, "1" is set into the key-on flag KONbit and ahead-of-timing sounding flag PREbit, and key number "50" corresponding to the manually performed note name "D3" is set into the manual performance buffer ManKno[0]. As a result, the settings of the above-mentioned flags KONbit, CLRbit, KOFbit, PREbit and LRbit change to "10111" as shown in FIG. 16A.

Figure 16A:
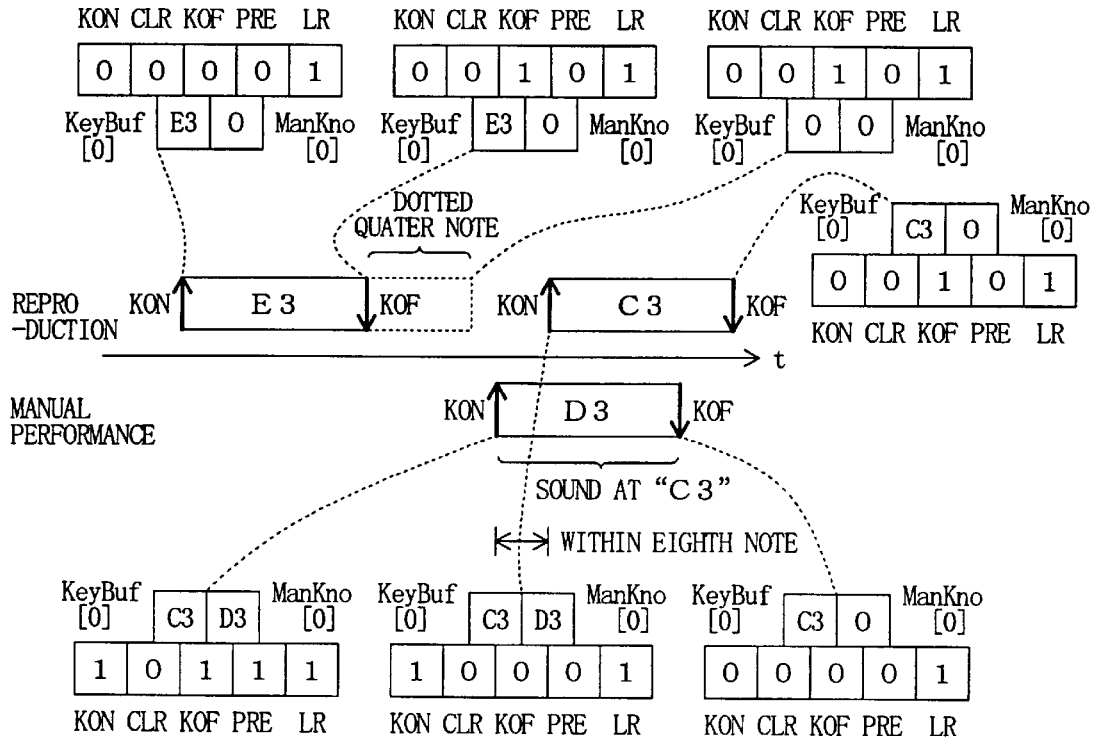
FIGS. 16A and 16B are diagrams explanatory of a fourth example of the manner in which the automatic performance device of the present invention operates in response to human player's performance operation.

Then, in response to reproduction of key-on event KON of note name "C3", the settings of the above-mentioned flags KONbit, CLRbit, KOFbit, PREbit and LRbit change to "10001" as shown in FIG. 16A.

Subsequently, once the manually-operated key of note name "D3" is released and key-off event KOF occurs, an affirmative determination is made at step 113 by way of steps 111 and 112. The tone of note name "C3" stored in the key buffer KeyBuf[0] is deadened at step 118. Thus, the settings of the above-mentioned flags KONbit, CLRbit, KOFbit, PREbit and LRbit change to "00001" as shown in FIG. 16A.

Then, in response to reproduction of key-off event KOF of note name "C3", the settings of the above-mentioned flags KONbit, CLRbit, KOFbit, PREbit and LRbit change to "00101".

Next, with reference to FIG. 16B, a description will be made about the operation of the automatic performance device when the key of note name "F3" is depressed after reproduction of key-on event KON of note name "C3" and continues to be depressed even after reproduction of key-on event KON of next note name "C3" and another key of note name "D3" is depressed during the depression of the "F3" key within the time corresponding to an eighth note before reproduction of key-on event KON of further next note name "C3".

In this case, operations responsive to reproduction of the key-on event of note name "C3" and manual depression of the key of note name "F3" are the same as those in the example of FIG. 15A and will not be described in detail to avoid unnecessary duplication.

In response to reproduction of key-off event KOF of note name "C3", the settings of the above-mentioned flags KONbit, CLRbit, KOFbit, PREbit and LRbit change to "10101".

Then, key-on event KON occurs by manual depression of the key of note name "D3", in response to which a negative determination is made at step 91, 94 and 97 of FIG. 9 so that the pre-read process of step 9B (FIG. 10) is carried out. Because note name "C3" is currently stored in the key buffer KeyBuf[0] whose key-on flag is at "1", an affirmative determination is made at step 104, so that the tone of note name "C3" stored in the pre-read buffer PreLdBuf[j+1] is deadened at step 105. After that, a tone of note name "C3" stored in the pre-read buffer PreLdBuf[j+1] is newly generated at step 107.

In the buffer setting process of step 108 in FIG. 6, key number "48" corresponding to note name "C3" is set into the key buffer KeyBuf[0]. Thus, the settings of the above-mentioned flags KONbit, CLRbit, KOFbit, PREbit and LRbit of the key buffer KeyBuf[0] change to "10001". Then, at step 109, "1" is set into the key-on flag KONbit and ahead-of-timing sounding flag PREbit, and key number "50" corresponding to the manually performed note name "D3" is set into the manual performance buffer ManKno[0]. As a result, the settings of the above-mentioned flags KONbit, CLRbit, KOFbit, PREbit and LRbit change to "10111" as shown in FIG. 16B.

Figure 16B:
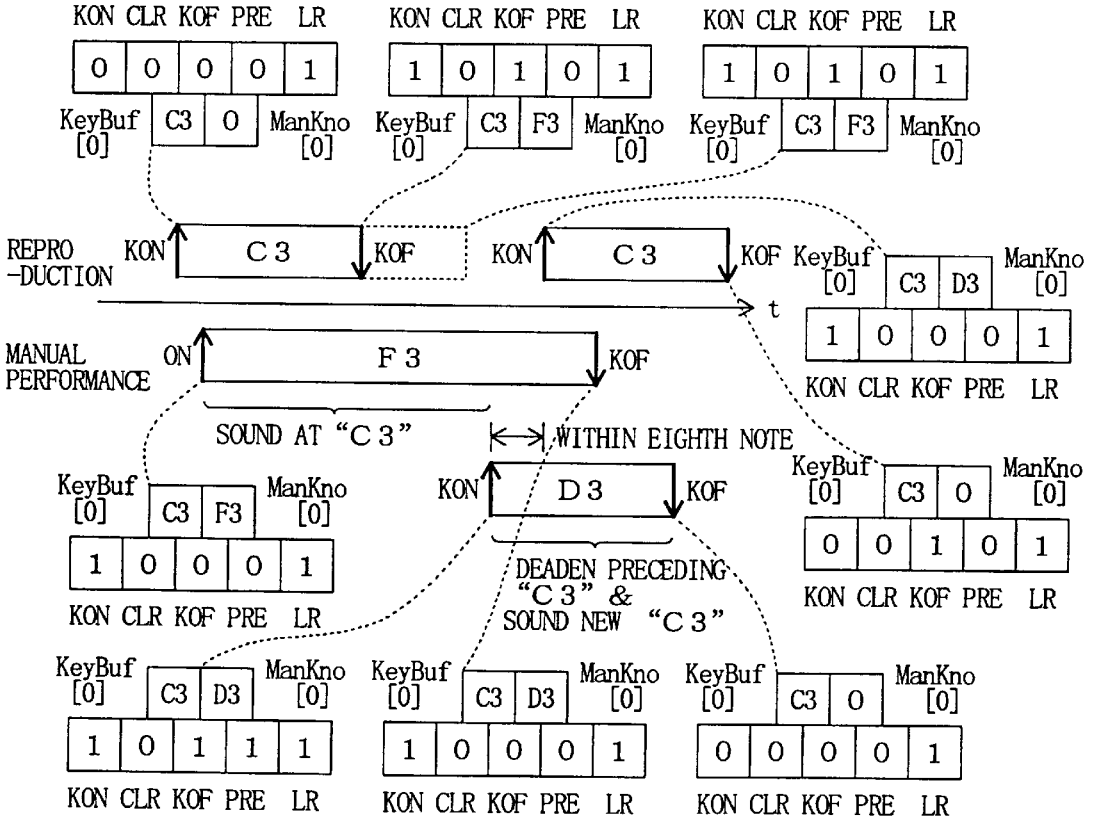

Then, in response to reproduction of key-on event KON of note name "C3", the settings of the above-mentioned flags KONbit, CLRbit, KOFbit, PREbit and LRbit change to "10001" as shown in FIG. 16B. Thus, by this time, two key-on events have occurred for left-hand performance.

Subsequently, once the manually-operated key of note name "F3" is released and key-off event KOF occurs, an affirmative determination is made at step 111 and a negative determination is made at step 113, so that the process comes to an end without doing anything further.

Subsequently, once the manually-operated key of note name "D3" is released and key-off event KOF occurs, an affirmative determination is made at step 113 by way of steps 111 and 112. The tone of note name "C3" stored in the key buffer KeyBuf[0] is deadened at step 118. Because an affirmative determination is made at step 119 in this case, "0" is set into the key-on flag KONbit at step 11A and also "0" is set into the manual performance buffer ManKno[0] at step 11C. Thus, the settings of the above-mentioned flags KONbit, CLRbit, KOFbit, PREbit and LRbit change to "00001" as shown in FIG. 16B.

Then, in response to reproduction of key-off event KOF of note name "C3", the settings of the above-mentioned flags KONbit, CLRbit, KOFbit, PREbit and LRbit change to "00101". Because the key-on flag KONbit is currently at "0", an affirmative determination is made at step 73 and "0" is set into the manual performance buffer ManKno[0] and time counter KofCnt[i] at step 74.

The tone of note name "C3" may be generated after deadening the tone of preceding note name "C3" as shown in FIG. 16B, or the same tone of preceding note name "C3" continues to be generated as in the example of FIG. 15B.

Figure 17A:
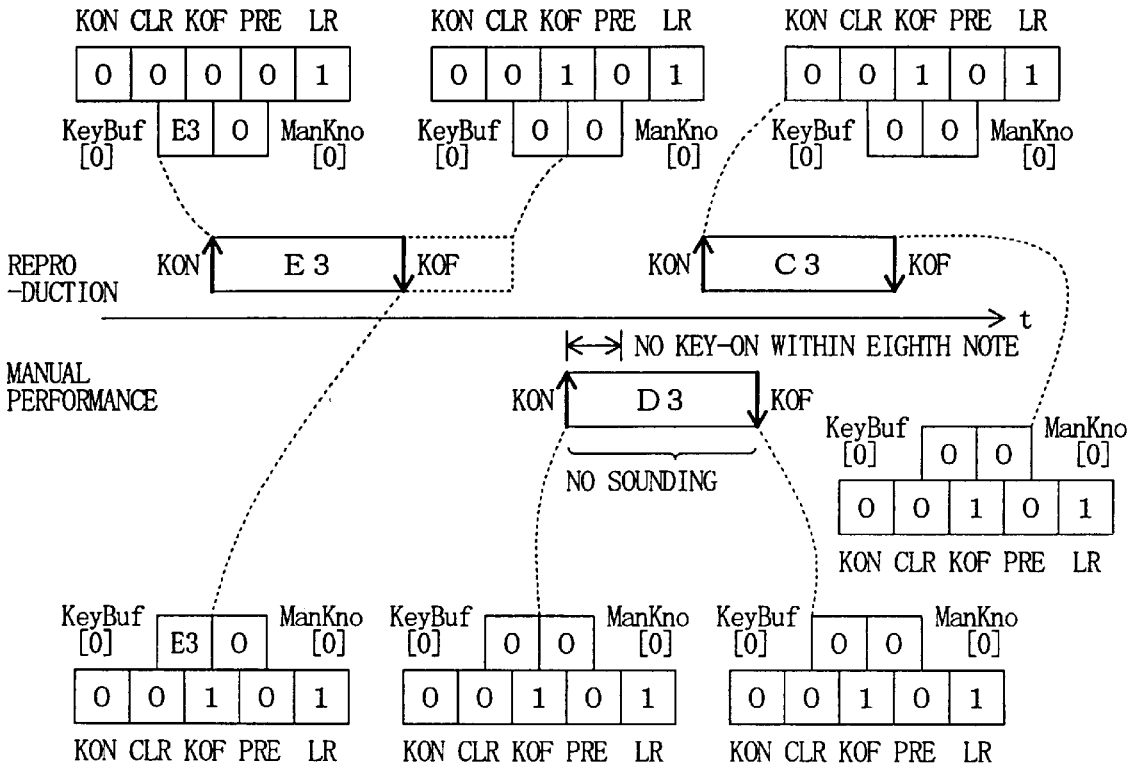
FIGS. 17A an 17B are diagrams explanatory of a fifth example of the manner in which the automatic performance device of the present invention operates in response to human player's performance operation.

Next, with reference to FIG. 17A, a description will be made about the operation of the automatic performance device when the key of note name "D3" is depressed after lapse of the time corresponding to a dotted quarter note following reproduction of key-off event KOF of note name "E3" and yet before the time corresponding to an eighth note preceding reproduction of key-on event of note name "C3".

In this case, operations responsive to reproduction of key-on event KON and key-off event KOF of note name "E3" and lapse of the time corresponding to an eighth note are the same as those in the example of FIG. 16A and will not be described in detail to avoid unnecessary duplication.

Then, key-on event KON occurs by manual depression of the key of note name "D3", in response to which a negative determination is made at step 91, 94 and 97 of FIG. 9 so that the pre-read process of step 9B (FIG. 10) is carried out. Because the value currently set in the duration counter DurCnt is greater than the time length corresponding to an eighth note in this case, the pre-read process is terminated without doing anything further.

Then, in response to reproduction of key-on event KON of note name "C3", key number "48" corresponding to note name "C3" is set into the key buffer KeyBuf[0].

Subsequently, once the manually-operated key of note name "D3" is released and key-off event KOF occurs, a negative determination is made at step 113 by way of steps 111 and 112, so that the process comes to an end without doing anything further.

Then, in response to reproduction of key-off event KOF of note name "C3", an affirmative determination is made at step 41, so that the buffer clearing process of step 42 in FIG. 7 is carried out. In this case, a negative determination is made at step 71 and thus the process comes to an end without doing anything further. Namely, in the case of FIG. 17A, no tone generating operations are performed.

Figure 17B:
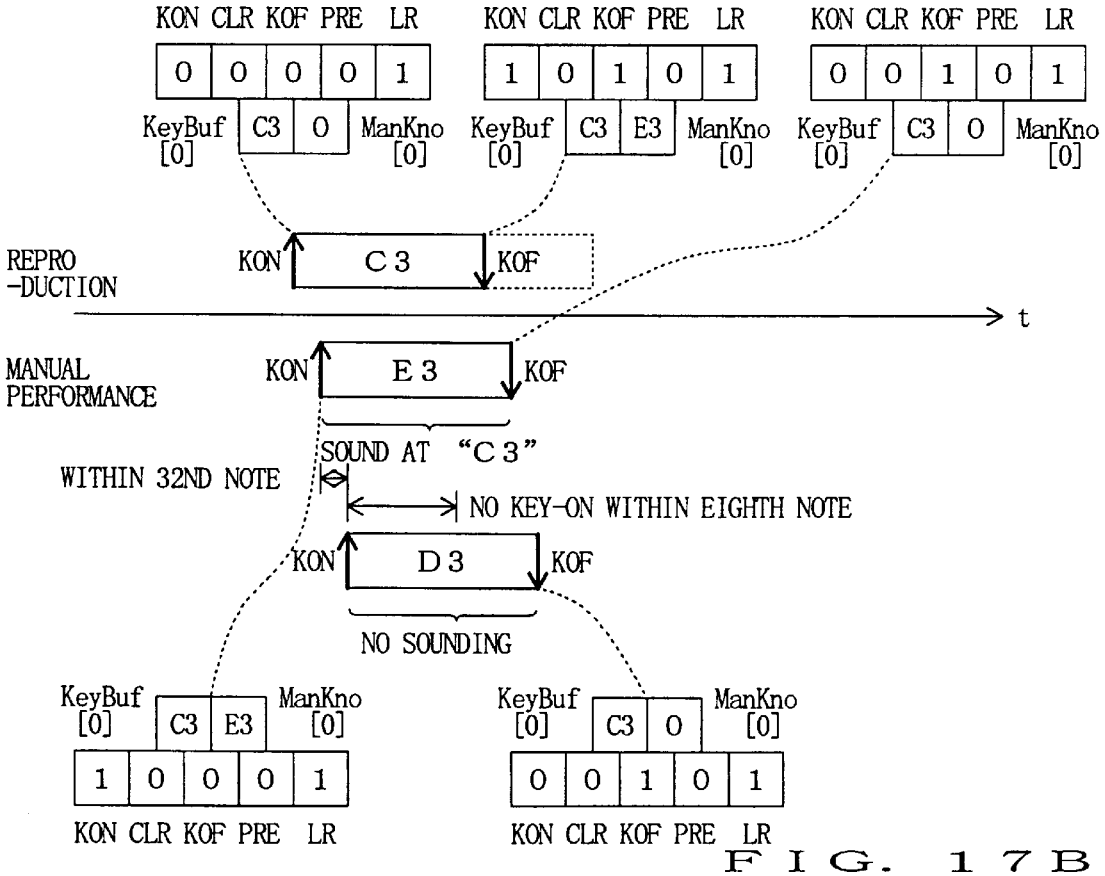

Finally, with reference to FIG. 17B, a description will be made about the operation of the automatic performance device when the key of note name "D3" is depressed within the time corresponding to a thirty-second note immediately after depression of the key of note name "E3".In this case, in response to reproduction of key-on event KON of note name "C3", key number "48" corresponding to note name "C3" is set into the key buffer KeyBuf[0]. Thus, the settings of the above-mentioned flags KONbit, CLRbit, KOFbit, PREbit and LRbit change to "00001" as shown in FIG. 17B.

Then, once key-on event KON occurs by manual depression of the key of note name "E3" immediately after that, a tone of note name "C3" set in the key buffer KeyBuf[0] is generated in a similar manner to FIG. 1A. As a result, the settings of the above-mentioned flags KONbit, CLRbit, KOFbit, PREbit and LRbit change to "10001".

After the occurrence of the key-on event of note name "E3", the key of note name "D3" is depressed within the time corresponding to a thirty-second note. Because the count of the time counter KonCnt[0] is now smaller than the time length of a thirty-second note, the pre-read process of step 9B in FIG. 10 is carried out by way of steps 91, 94 and 97 of FIG. 9. In the example of FIG. 17B, no note to be sounded is present in the pre-read buffer PreLdBuf[j] within the time length of an eighth note from the current point, the manual performance processing of FIG. 8 is terminated without generating a tone.

Then, in response to reproduction of key-off event KOF of note name "C3", an affirmative determination is made at step 41, so that the buffer clearing process of step 42 in FIG. 7 is carried out. In this case, an affirmative determination is made at step 71, so that "1" is set into the key-off flag KOFbit at step 72. Thus, the settings of the above-mentioned flags KONbit, CLRbit, KOFbit, PREbit and LRbit have now changed to "10101" as shown in FIG. 17B. Subsequently, once the manually-operated key of note name "E3" is released and key-off event KOF occurs immediately after the reproduction of key-off event KOF of note name "C3", a negative determination is made at step 113 by way of steps 111 and 112, so that the tone of note name "C3" stored in the key buffer KeyBuf[0] is deadened at step 118.

Then, once the manually-operated key of note name "D3" is released and key-off event KOF occurs, a negative determination is made at step 111, and a negative determination is made at steps 112 and 113 because no other key than the released key is being depressed, so that the process comes to an end without doing anything further.

Namely, even when the key of note name "D3" is depressed within the time corresponding to a thirty-second note immediately after depression of the key of note name "E3" as shown in FIG. 17B, no particular tone generating operations are executed.

In summary, the automatic performance device according to the above-described embodiment permits tone generation, well adapted to human player's actual performance operation, such that in the guide mode, a note from the right-hand or left-hand performance guide track is sounded as the player depresses any desired key on the keyboard during reproduction of automatic performance data from the individual recording tracks, the note continues to be sounded until release of the key, and the sounding of the note is terminated upon release of the key.

Even when the player depresses keys somewhat ahead of or behind predetermined note-on and note-off timing recorded in the performance guide track, the automatic performance device can generate tones with considerable appropriate musical intervals.

Further, even when the player's key depression stagnates, the automatic performance device can prevent suspension of the performance and thus allows the player to enjoy a satisfactory musical performance.

In response to depression of only a single key, the automatic performance device can sound a chord recorded in the performance guide track. A chord can also be sounded by normal key depression for chord performance.

When a plurality of keys are depressed together, only one tone generation takes place as long as the time differences or intervals among the key depressions are within the time length corresponding to a thirty-second note.

By the player using both hands to depress keyboard keys corresponding roughly to pitches of reproduced data for a right-hand or left-hand performance, tone generation for the right-hand performance guide track and left-hand performance guide track can be controlled independently of each other. This way, tone generating operation can be executed as if the player were performing with both hands.

Further, because the key split point is allowed to vary in an optimum manner rather than being fixed, the automatic performance device permits a performance while moving a key depression range in accordance with desired reproduction.

Whereas the preferred embodiment has been described as dividing the keys using the key split point, the invention is not so limited and the tone generating operations for the two tracks may be executed using the entire key range.

Further, only one performance guide track may be provided, rather than the two performance guide tracks for right and left hands.

Furthermore, whereas the preferred embodiment has been described as permitting tone generation when a manual key-on event occurs within the time length of an eighth note before key-on data read out from the guide track and within the time length of a dotted quarter note after corresponding key-off data, the grace period for the tone generation permission may be other than the above-described; it may be either within the time length of an eighth note before key-on data read out from the guide track or within the time length of a dotted quarter note after key-off data.

Moreover, whereas the preferred embodiment is designed to determine, as erroneous key depression, two successive manual key-on events occurring within the time length of a thirty-second note, such erroneous key depression may be determined using other criteria.

Furthermore, in generating a tone on the basis of performance data read out from the performance guide track, volume and the like of the tone to be generated may be controlled in accordance with velocity data contained in the performance data or velocity detected of an actually depressed key. Alternatively, volume and the like of the tone may be controlled on the basis of a value obtained by modifying the velocity data in accordance with the velocity detected of an actually depressed key.

In addition, the automatic performance device of the present invention may be applied to any other types of musical instrument than those capable of visually instructing key depression by means of a piano roll staff or LEDs provided on or adjacent to the keyboard.

With the arrangements having so far been described, the present invention affords the benefit that by a human operator just imitatively activating a particular performance operator, it can execute a musical performance in such a manner as if the operator were actually carrying out desired performance operation.

What is claimed is:

1. An automatic performance device comprising:

an automatic performance data supplying section that supplies automatic performance data in accordance with a set performance tempo, the automatic performance data including information indicative of at least a note designating a tone pitch and a key-on event instructing start of tone generation;

a manual performance data supplying section that supplies manual performance data in response to performance operation by a human player, the manual performance data including information indicative of at least a note designating a tone pitch and a key-on operation for instructing start of tone generation; and a control unit coupled to said automatic performance data supplying section and manual performance data supplying section, said control unit adapted to execute, in response to said information supplied by said automatic performance data supplying section and manual performance data supplying section and when it is determined that a key-on operation of a manual performance occurs between a predetermined time point before key-on event timing of a given note of the automatic performance data and a given time point after the key-on event timing of said given note of the automatic performance data, control such that generation of a tone corresponding to the given note of the automatic performance data should start at a time point corresponding to occurrence of the key-on operation of the manual performance, wherein said control unit is further adapted to execute, when key-on events of a plurality of automatic performance notes occur within a predetermined period and a key-on operation of a manual performance occurs between a predetermined time point before key-on event timing of each of said automatic performance notes and a given time point after the key-on event timing of each automatic performance notes, control such that generation of tones corresponding to the plurality of automatic performance notes should start in response to occurrence of the key-on operation of the manual performance.

2. An automatic performance device as recited in claim 1 wherein if key-off event timing of a given note of the automatic performance data is within a predetermined allowable time difference from a time point when a key-on operation of the manual performance occurs and a tone corresponding to the given note remains to be generated, said control unit further executes control such that generation of the tone corresponding to the given note should start at the time point corresponding to occurrence of the key-on operation of the manual performance.

3. An automatic performance device as recited in claim 2 wherein when a key-off operation of manual performance occurs, said control unit executes further control to deaden the tone corresponding to said given note of the automatic performance data which has been generated in response to said key-on operation of the manual performance.

4. An automatic performance device as recited in claim 1 wherein said control unit executes control such that generation timing of the tone corresponding to said given note of the automatic performance data is changed from the key-on event timing of the given note to the time point corresponding to occurrence of the specific key-on operation of the manual performance.

5. An automatic performance device as recited in claim 1 wherein said given time point after said key-on event timing of said given note of the automatic performance data is a predetermined time point after occurrence of a key-off event of the given note of the automatic performance data.

6. An automatic performance device comprising:

an automatic performance data supplying section that supplies automatic performance data in accordance with a set performance tempo, the automatic performance data including information indicative of at least a note designating a tone pitch and a key-on event instructing start of tone generation;

a manual performance data supplying section that supplies manual performance data in response to performance operation by a human player,the manual performance data including information indicative of at least a note designating a tone pitch and a key-on operation for instructing start of tone generation; and a control unit coupled to said automatic performance data supplying section and manual performance data supplying section, said control unit adapted to execute, in response to said information supplied by said automatic performance data supplying section and manual performance data supplying section, wherein when it is determined that key-on events of a plurality of automatic performance notes occur within a predetermined period and a key-on operation of a manual performance occurs between a predetermined time point before key-on event timing of each of said automatic performance notes and a given time point after the key-on event timing of each automatic performance notes, control such that generation of tones corresponding to the plurality of automatic performance notes should simultaneously start at a time point corresponding to occurrence of the key-on operation of the manual performance.

7. An automatic performance device comprising:

an automatic performance data supplying section that supplies automatic performance data in accordance with a set performance tempo, the automatic performance data including information indicative of at least a note designating a tone pitch and a key-on event instructing start of tone generation;

a manual performance data supplying section that supplies manual performance data in response to performance operation by a human player, the manual performance data including information indicative of at least a note designating a tone pitch and a key-on operation for instructing start of tone generation; and a control unit responsive to said information supplied by said automatic performance data supplying section and manual performance data supplying section for, when a key-on operation of a manual performance occurs between a predetermined time point before key-on event timing of a given note of the automatic performance data and a given time point after the key-on event timing of said given note of the automatic performance data, executing control such that generation of a tone corresponding to the given note of the automatic performance data should start at a time point corresponding to occurrence of the key-on operation of the manual performance, wherein when a key-off operation of the manual performance occurs, said control unit executes further control to deaden the tone corresponding to said given note of the automatic performance data which has been generated in response to said key-on operation of the manual performance.

8. An automatic performance device comprising:

an automatic performance data supplying section that supplies automatic performance data in accordance with a set performance tempo, the automatic performance data including information indicative of at least a note designating a tone pitch and a key-on event instructing start of tone generation;

a manual performance data supplying section that supplies manual performance data in response to performance operation by a human player, the manual performance data including information indicative of at least a note designating a tone pitch and a key-on operation for instructing start of tone generation; and a control unit responsive to said information supplied by said automatic performance data supplying section and manual performance data supplying section for, when a key-on operation of a manual performance occurs between a predetermined time point before key-on event timing of a given note of the automatic performance data and a given time point after the key-on event timing of said given note of the automatic performance data, executing control such that generation of a tone corresponding to the given note of the automatic performance data should start at a time point corresponding to occurrence of the key-on operation of the manual performance, wherein when key-on operations of first and second ones of said manual performance occur in succession, at an interval smaller than a predetermined value, within a particular period including at least a time from occurrence of a key-on event to occurrence of a key-off event of the given note of the automatic performance data, said control unit instructs start of generation of the tone based on the given note of the automatic performance data at a time corresponding to occurrence of the key-on operation of said first manual performance, but executes control such that the tone based on the given note of the automatic performance data is not generated at a time point corresponding to occurrence of the key-on operation of said second manual performance.

9. An automatic performance device comprising:

an automatic performance data supplying section that supplies automatic performance data in accordance with a set performance tempo, the automatic performance data including information indicative of at least a note designating a tone pitch and a key-on event instructing start of tone generation;

a manual performance data supplying section that supplies manual performance data in response to performance operation by a human player, the manual performance data including information indicative of at least a note designating a tone pitch and a key-on operation for instructing start of tone generation; and a control unit responsive to said information supplied by said automatic performance data supplying section and manual performance data supplying section for, when a key-on operation of a manual performance occurs between a predetermined time point before key-on event timing of a given note of the automatic performance data and a given time point after the key-on event timing of said given note of the automatic performance data, executing control such that generation of a tone corresponding to the given note of the automatic performance data should start at a time point corresponding to occurrence of the key-on operation of the manual performance, wherein when key-on operations of first and second ones of said manual performance occur in succession, at an interval smaller than a predetermined value, within a particular period including at least a time from occurrence of a key-on event to occurrence of a key-off event of the given note of the automatic performance data, said control unit instructs start of generation of the tone based on the given note of the automatic performance data at a time point corresponding to occurrence of the key-on operation of said first manual performance, but executes control such that the tone based on the automatic performance note is not generated at a time point corresponding to occurrence of the key-on operation of said second manual performance, and wherein when a key-off operation of said first manual performance occurs and then a key-off operation of said second manual performance occurs before occurrence of the key-off event of the given note of the automatic performance data, said control unit allows the generation of the tone based on the given note of the automatic performance data to continue even after occurrence of the key-off operation of said first manual performance and instructs deadening of the tone based on the given note of the automatic performance data at a time point corresponding to occurrence of the key-off operation of said second manual performance.

10. An automatic performance device comprising:

an automatic performance data supplying section that supplies automatic performance data in accordance with a set performance tempo, the automatic performance data including information indicative of at least a note designating a tone pitch and a key-on event instructing start of tone generation;

a manual performance data supplying section that supplies manual performance data in response to performance operation by a human player, the manual performance data including information indicative of at least a note designating a tone pitch and a key-on operation for instructing start of tone generation; and a control unit responsive to said information supplied by said automatic performance data supplying section and manual performance data supplying section for, when a key-on operation of a manual performance occurs between a predetermined time point before key-on event timing of a given note of the automatic performance data and a given time point after the key-on event timing of said given note of the automatic performance data, executing control such that generation of a tone corresponding to the given note of the automatic performance data should start at a time point corresponding to occurrence of the key-on operation of the manual performance, wherein when key-on operations of first and second ones of said manual performance occur in succession, at an interval greater than a predetermined value, within a particular period including at least a time from occurrence of a key-on event to occurrence of a key-off event of the given note of the automatic performance data, said control unit instructs start of generation of the tone based on the given note of the automatic performance data at a time point corresponding to occurrence of the key-on operation of said first manual performance, then temporarily instructs deadening of the tone based on the given note of the automatic performance data at a time point corresponding to occurrence of the key-on operation of said second manual performance and then instructs restart of generation of said tone.

11. An automatic performance device comprising:

an automatic performance data supplying section that supplies automatic performance data in accordance with a set performance tempo, the automatic performance data including information indicative of at least a note designating a tone pitch and a key-on event instructing start of tone generation;

a manual performance data supplying section that supplies manual performance data in response to performance operation by a human player, the manual performance data including information indicative of at least a note designating a tone pitch and a key-on operation for instructing start of tone generation; and a control unit responsive to said information supplied by said automatic performance data supplying section and manual performance data supplying section for, when a key-on operation of a manual performance occurs between a predetermined time point before key-on event timing of a given note of the automatic performance data and a given time point after the key-on event timing of said given note of the automatic performance data, executing control such that generation of a tone corresponding to the given note of the automatic performance data should start at a time point corresponding to occurrence of the key-on operation of the manual performance, wherein when key-on events of a plurality of automatic performance notes occur within a predetermined period, said control unit considers the automatic performance notes to be components of a chord and executes control such that generation of tones based on the automatic performance data remaining to be generated before occurrence of a key-on operation of the manual performance should simultaneously start at a time point corresponding to occurrence of the key-on operation of the manual performance.

12. An automatic performance device comprising:

an automatic performance data supplying section that supplies automatic performance data for right-hand performance and left-hand performance in accordance with a set performance tempo, the automatic performance data including information indicative of at least a note designating a tone pitch and a key-on event instructing start of a tone generation;

a manual performance section that supplies manual performance data in response to performance operation by a human player, the manual performance data including information indicative of at least a note designating a tone pitch and a key-on operation for instructing start of tone generation;

a split-point setting section that variably sets a split point for dividing said manual performance section into two note ranges on the basis of note information included in the automatic performance data for right-hand performance and left-hand performance supplied by said automatic performance data supplying section;

a determining section that, on the basis of note information included in the manual performance data supplied by said manual performance section, makes a determination as to which of the two note ranges said manual performance data belong to and selects either of the automatic performance data for right-hand performance and the automatic performance data for left-hand performance in correspondence with the manual performance data on the basis of a result of the determination; and a control unit that controls generation of a tone based on the note information included in the automatic performance data selected by said determining section, in accordance with key-on operation timing of the manual performance.

13. An automatic performance device as recited in claim 12 wherein said control unit determines automatic performance data to be sounded, on the basis of relation between key-on operation timing of the manual performance and key-on event and key-off event timing of said selected automatic performance data, and said control unit controls generation of a tone based on the note information included in the determined automatic performance data in accordance with the key-on operation timing of the manual performance.

14. An automatic performance device as recited in claim 12 which further comprises a mode selecting section that selects a performance mode from among a right-hand performance mode and a left-hand performance mode, and wherein said determination section controls such that when the right-hand performance mode is selected by said mode selection section, the automatic performance data for the right-hand performance is selected in correspondence with the manual performance data belonging to a note range for the right-hand performance, and when the left-hand performance mode is selected by said mode selection section, the automatic performance data for the left-hand performance is selected in correspondence with the manual performance data belonging to a note range for the left-hand performance, and said control section controls the generation of the tone in correspondence with the manual performance data supplied in the selected performance mode.

15. An automatic performance device as recited in claim 12 which further comprises a display section that visually displays the split point variably set by said split-point setting section.

16. An automatic performance method comprising:

a first step of supplying automatic performance data in accordance with a set performance tempo, the automatic performance data including information indicative of at least a note designating a tone pitch and a key-on event instructing start of tone generation;

a second step of supplying manual performance data in response to performance operation by a human player, the manual performance data including information indicative of at least a note designating a tone pitch and a key-on operation for instructing start of tone generation;

a third step of, in response to said information supplied by said first and second steps, and when it is determined that a key-on operation of a manual performance occurs between a predetermined time point before key-on event timing of a given note of the automatic performance data and a given time point after the key-on event timing of said given note of the automatic performance data, executing control such that generation of a tone corresponding to the given note of the automatic performance data should start at a time point corresponding to occurrence of the key-on operation timing of the manual performance; and a fourth step of further executing control, when key-on events of a plurality of automatic performance notes occur within a predetermined period and a key-on operation of a manual performance occurs between a predetermined time point before key-on event timing of each of said automatic performance notes and a given time point after the key-on event timing of each automatic performance notes, such that generation of tones corresponding to the plurality of automatic performance notes should start in response to occurrence of the key-on operation of the manual performance.

17. An automatic performance method comprising:

a step of supplying automatic performance data for right-hand performance and left-hand performance in accordance with a set performance tempo, the automatic performance data including information indicative of at least a note designating a tone pitch and a key on event instructing start of tone generation;

a step of supplying manual performance data in response to performance operation by a human player, the manual performance data including information indicative of at least a note designating a tone pitch and a key-on event instructing start of tone generation;

a step of variably setting a split point between two note ranges on the basis of note information included in the automatic performance data for right-hand performance and left-hand performance supplied by said step of supplying automatic performance data;

a determining step of, on the basis of note information included in the manual performance data supplied by said step of supplying manual performance data, making a determination as to which of the two divided note ranges said manual performance data belong to and selecting either of the automatic performance data for right-hand performance and the automatic performance data for left-hand performance in correspondence with the manual performance data on the basis of a result of the determination; and a step of controlling generation of a tone based on the note information included in the automatic performance data selected by said determining step, in accordance with key-on operation timing of the manual performance.

18. A machine-readable recording medium containing a group of instructions of a program to be executed by a computer, said program comprising:

a first step of supplying automatic performance data in accordance with a set performance tempo, the automatic performance data including information indicative of at least a note designating a tone pitch and a key-on event instructing start of tone generation;

a second step of supplying manual performance data in response to performance operation by a human player, the manual performance data including information indicative of at least a note designating a tone pitch and a key-on operation for instructing start of tone generation;

a third step of, in response to said information supplied by first and second steps, when a key-on operation of a manual performance occurs between a predetermined time point before key-on event timing of a given note of the automatic performance data and a given time point after the key-on event timing of said given note of the automatic performance data, executing control such that generation of a tone corresponding to the given note of the automatic performance data should start at a time point corresponding to occurrence of the key-on operation timing of the manual performance; and a fourth step of further executing control, when key-on events of a plurality of automatic performance notes occur within a predetermined period and a key-on operation of a manual performance occurs between a predetermined time point before key-on event timing of each of said automatic performance notes and a given time point after the key-on event timing of each automatic performance notes, such that generation of tones corresponding to the plurality of automatic performance notes should start in response to occurrence of the key-on operation of the manual performance.

19. A machine-readable recording medium containing a group of instructions of a program to be executed by a computer, said program comprising:

a step of supplying automatic performance data for right-hand performance and left-hand performance in accordance with a set performance tempo, the automatic performance data including information indicative of at least a note designating a tone pitch and a key on event instructing start of tone generation;

a step of supplying manual performance data in response to performance operation by a human player, the manual performance data including information indicative of at least a note designating a tone pitch and a key-on operation for instructing start of tone generation;

a step of variably setting a split point to determine two divided note ranges on the basis of note information included in the automatic performance data for right-hand performance and left-hand performance supplied by said step of supplying automatic performance data;

a determining step of, on the basis of note information included in the manual performance data supplied by said step of supplying manual performance data, making a determination as to which of the two divided note ranges said manual performance data belong to and selecting either of the automatic performance data for right-hand performance and the automatic performance data for left-hand performance in correspondence with the manual performance data on the basis of a result of the determination; and a step of controlling generation of a tone based on the note information included in the automatic performance data selected by said determining step, in accordance with key-on operation timing of the manual performance.

20. An automatic performance device comprising:

an automatic performance data supplying section that supplies automatic performance data in accordance with a set performance tempo, the automatic performance data including information indicative of at least a note and a key-on event;

a manual performance data supplying section that supplies manual performance data in response to performance operation by a human player, the manual performance data including information indicative of at least a note and a key-on event; and a control unit that if key-on event timing of a given note of the automatic performance data is within a predetermined allowable time difference from key-on event timing of the manual performance data and a tone corresponding to the given note remains to be generated, executes control such that generation of the tone corresponding to the given note should start at a time point corresponding to the key-on event timing of the manual performance data, wherein when key-on events of first and second said manual performance data occur in succession, at an interval smaller than a predetermined value, within a particular period including at least a time from occurrence of a key-on event to occurrence of a key-off event of the given note of the automatic performance data, said control unit instructs start of generation of the tone based on the given note of the automatic performance data at a time point corresponding to occurrence of the key-on event of said first manual performance data, but executes control such that the tone based on the automatic performance note is not generated at a time point corresponding to occurrence of the key-on event of said second manual performance data, and wherein when a key-off event of said first manual performance data occurs and then a key-off event of said second manual performance data occurs before occurrence of the key-off event of the given note of the automatic performance data, said control unit allows the generation of the tone based on the given note of the automatic performance data to continue even after occurrence of the key-off event of said first manual performance data and instructs deadening of the tone based on the given note of the automatic performance data at a time point corresponding to occurrence of the key-off event of said second manual performance data.

21. An automatic performance device comprising:

an automatic performance data supplying section that supplies automatic performance data in accordance with a set performance tempo, the automatic performance data including information indicative of at least a note and a key-on event;

a manual performance data supplying section that supplies manual performance data in response to performance operation by a human player, the manual performance data including information indicative of at least a note and a key-on event; and a control unit that if key-on event timing of a given note of the automatic performance data is within a predetermined allowable time difference from key-on event timing of the manual performance data and a tone corresponding to the given note remains to be generated, executes control such that generation of the tone corresponding to the given note should start at a time point corresponding to the key-on event timing of the manual performance data, wherein when key-on events of a plurality of automatic performance notes occur within a predetermined period, said control unit considers the automatic performance notes to be components of a chord and executes control such that generation of tones based on the automatic performance data remaining to be generated before occurrence of a key-on event of the manual performance data should simultaneously start at a time point corresponding to occurrence of the key-on event of the manual performance data.

* * * * *